US012329300B2

(12) United States Patent
Pontecorvo

(10) Patent No.: US 12,329,300 B2
(45) Date of Patent: Jun. 17, 2025

(54) RECYCLABLE OR REUSABLE STRAW IN CONTAINER LID ASSEMBLY

(71) Applicant: Gary J. Pontecorvo, Stockton, NJ (US)

(72) Inventor: Gary J. Pontecorvo, Stockton, NJ (US)

( * ) Notice: Subject to any disclaimer, the term of this patent is extended or adjusted under 35 U.S.C. 154(b) by 306 days.

(21) Appl. No.: 17/706,677

(22) Filed: Mar. 29, 2022

(65) Prior Publication Data

US 2022/0218136 A1 Jul. 14, 2022

Related U.S. Application Data

(63) Continuation-in-part of application No. 16/735,423, filed on Jan. 6, 2020, now Pat. No. 11,291,321.

(51) Int. Cl.
*A47G 21/18* (2006.01)
*B65D 43/02* (2006.01)

(52) U.S. Cl.
CPC ..... *A47G 21/189* (2013.01); *B65D 43/0202* (2013.01); *B65D 2231/022* (2013.01)

(58) Field of Classification Search
CPC .... A47G 21/189; A47G 21/18; A47G 21/186; A47G 2019/2277; A47G 19/2272; B65D 43/0202; B65D 2231/022; B65D 77/28; B65D 47/06; B65D 2543/00046; B65D 2543/00092
USPC ..... 215/388, 306, 12.1; 220/708, 521, 285
See application file for complete search history.

(56) References Cited

U.S. PATENT DOCUMENTS

| | | | | |
|---|---|---|---|---|
| 4,109,817 | A * | 8/1978 | Payne | B65D 77/283 220/706 |
| 6,102,568 | A | 8/2000 | Davis | |
| 8,579,148 | B2 | 11/2013 | Slansky | |
| 10,011,413 | B1 | 7/2018 | Ryan | |
| 10,123,641 | B1 | 11/2018 | Pepper | |
| 10,165,849 | B2 | 1/2019 | Chen | |
| 10,660,464 | B2 * | 5/2020 | Pepper | A47G 21/186 |
| 10,835,065 | B2 * | 11/2020 | Löhn | B65D 47/248 |
| 2001/0054618 | A1 * | 12/2001 | Ferrari | B65D 17/4012 220/706 |
| 2011/0233297 | A1 * | 9/2011 | Roche | A47G 21/18 239/33 |
| 2011/0315698 | A1 | 12/2011 | Donaldson | |
| 2013/0020402 | A1 | 1/2013 | Wallace | |
| 2013/0200088 | A1 | 8/2013 | Muir, III | |
| 2015/0291309 | A1 | 10/2015 | McGregor | |

(Continued)

FOREIGN PATENT DOCUMENTS

| | | | |
|---|---|---|---|
| CN | 201951829 U | | 8/2011 |
| CN | 107380735 A | * | 11/2017 |

(Continued)

*Primary Examiner* — Nathan J Jenness
*Assistant Examiner* — John Martin Hoppmann
(74) *Attorney, Agent, or Firm* — Gearhart Law, LLC

(57) ABSTRACT

A recyclable or reusable assembly is described. The assembly includes a lid having a first side disposed opposite a second side that engages an opening of a container and a hole extending through a width of the lid. The assembly also includes at least a straw having a first portion and a second portion. The assembly further includes a first sealing plug affixed to a first side of the first portion of the straw and a second sealing plug affixed to a first side of the second portion of the straw. The assembly also includes at least one mechanism to secure the first sealing plug and the second sealing plug to the lid or the straw.

18 Claims, 40 Drawing Sheets

(56) References Cited

U.S. PATENT DOCUMENTS

| | | | | |
|---|---|---|---|---|
| 2015/0305528 | A1* | 10/2015 | Chen | A47G 19/2266 220/666 |
| 2016/0145011 | A1 | 5/2016 | Savel | |
| 2016/0200486 | A1* | 7/2016 | Meyers | B65D 81/3283 215/229 |
| 2016/0309930 | A1* | 10/2016 | Stewart | A47G 21/18 |
| 2017/0112306 | A1 | 4/2017 | Muir, III | |
| 2017/0318995 | A1* | 11/2017 | Rai | A47J 43/27 |
| 2019/0038058 | A1 | 2/2019 | Abbott-Glazier | |
| 2019/0082815 | A1 | 3/2019 | Chen | |
| 2019/0099025 | A1 | 4/2019 | Rieger | |
| 2020/0046152 | A1* | 2/2020 | Ribi | B65D 51/24 |

FOREIGN PATENT DOCUMENTS

| | | | |
|---|---|---|---|
| WO | 2011120037 | A2 | 9/2011 |
| WO | 2011127566 | A1 | 10/2011 |

* cited by examiner

RECYCLABLE OR REUSABLE STRAW IN CONTAINER LID ASSEMBLY

CROSS-REFERENCE TO RELATED APPLICATIONS SECTION

This application is a U.S. Non-Provisional Patent Application and a Continuation-in-Part (CIP) Patent Application that claims priority to U.S. Non-Provisional patent application Ser. No. 16/735,423 filed on Jan. 6, 2020, the entire contents of which are hereby incorporated by reference in their entirety.

FIELD OF THE EMBODIMENTS

The field of the invention and its embodiments relate to recyclable or reusable lid and straw assemblies configured to engage a container. In particular, the present invention and its embodiments provide both a reusable and spill-proof container assembly that is dishwasher safe and a recyclable lid and straw assembly that increases the likelihood that traditionally used recycling equipment will recycle the assembly.

BACKGROUND OF THE EMBODIMENTS

With an increased emphasis on environmental protection efforts, elimination of common plastic straws has received increased media attention. Plastic straws are a single-use product and are available in numerous sizes. However, due to their popularity, it has been estimated that Americans use over 500 million plastic straws each day. Though these common plastic straws can technically be recycled, plastic straws are small, thin, and easily bendable. The lightweight nature of these straws results in them falling into cracks and crevices of recycling machinery, and as such, most recyclers do not accept plastic straws, and most straws that do make it to a recycling facility do not become recycled. As such, most of these plastic straws end up polluting the oceans or being dumped into landfills.

To remedy this pollution crisis, many cities and countries have restricted use of single-use plastic straws. An alternative to use of plastic straws is use of reusable straws, which may be made out of stainless steel or glass, for example. Though these reusable straws are dishwasher-safe, they are often difficult to clean, must be carried by the user, and are costly to purchase. Others have contemplated use of recyclable paper straws as a greener option to single-use plastic straws. Though recyclable paper straws are biodegradable, take less time to decompose, as compared to plastic straws, and are safer for wildlife, recyclable paper straws quickly lose their form, and therefore their usefulness, when submerged in a liquid.

Thus, a need exists for a reusable and spill-proof container assembly that is dishwasher safe. A need also exists for a recyclable lid and straw assembly that increases the likelihood that traditionally used recycling equipment will recycle the assembly.

REVIEW OF RELATED TECHNOLOGY

U.S. Pat. No. 6,102,568 A relates to a collapsible, recyclable, fluid receptacle readily assembled from either single blank or two substantially identical blanks to form an outer shell and a flexible inner liner attached to the shell to retain a liquid therein without leaking.

U.S. Pat. No. 8,579,148 B2 describes a reusable straw that includes a first part having a hollow elongated body that has a first end and an opposing second end and a second part having a hollow elongated body that has a first end and an opposing second end. The second part has a width that allows the first part to be received within a hollow interior of the first part. A first coupling member is formed along an inner surface of the first part proximate the first end. A second coupling member is formed along an outer surface of the second part at the first end thereof. The first and second coupling members mate together to securely couple the second part to the first part.

U.S. Pat. No. 10,011,413 B1 describes a drinking straw wrapper that comprises an upper portion and a lower portion detachably engaged with the upper portion. The upper and lower portions are collectively configured to enclose a drinking straw. Detachment of the upper portion from the lower portion creates an opening in the upper portion and an opening in the lower portion, with the opening in the upper portion being substantially wider than the opening in the lower portion so as to facilitate replacement of the upper portion on a top of the straw after its initial removal therefrom. The upper portion may be formed from a first material and the lower portion formed from a second material different than the first material. Alternatively, the upper portion may be formed from a material having a first thickness and the lower portion formed from a same material but having a second thickness that is less than the first thickness.

U.S. Pat. No. 10,123,641 B1 describes a reusable drinking straw that is foldable into a compact configuration for storage. The straw comprises a rigid external tube and a flexible internal tube that is foldable into a compact configuration for storage. In a folded configuration, the reusable straw has a significantly reduced length. The external tube of the straw is preferably formed of multiple rigid segments for supporting the flexible internal tubing in the extended configuration during use as a drinking straw.

U.S. Pat. No. 10,165,849 B2 describes a collapsible, reusable drinking container that has a first opening suitable for pouring and filling, a second opening for accessing the interior of the container for cleaning, and a flexible straw for drinking the contents while the container is held in an upright position.

U.S. Patent Application Publication No. 2011/0315698 A1 describes a multiple straw fluid dispenser that includes a cap assembly containing two or more straws, where each of the two or more straws are accessible to one or more users for the purpose of drinking one or more fluids.

WO 2011/120037 A2 describes a drinking straw that can be easily inserted through a lid or into a beverage pouch or box.

U.S. Patent Application Publication No. 2013/0200088 A1 relates to drink-through lids that may be placed over and attached to disposable and reusable beverage cups. The drink-through lids provide a drink-through opening near the perimeter of the lid's top surface for easy drinking.

WO 2011/127566 A1 describes a collapsible container that is movable from a collapsed position (having a reduced volume for storage and transport) and an expanded position (having dimensional rigidity to securely hold the contents of the container).

U.S. Patent Application Publication No. 2016/0145011 A1 describes a resilient lid insert or membrane construction that is outfitted upon a lidded beverage container for enabling the user to transfer heat from a relatively hot assembly-contained beverage prior to consumption.

U.S. Patent Application Publication No. 2017/0112306 A1 describes anti-spill disposable and reusable drink-through lids for hot and cold disposable and reusable beverage cups. The drink-through lids may be placed over and attached to disposable and reusable beverage cups.

U.S. Patent Application Publication No. 2019/0038058 A1 describes a reusable straw assembly. The assembly includes an inner and outer member which, when fitted together, form the straw. Each member has a tab at one end to inhibit the member from falling out of a dishwasher while the member is being washed. Each member includes a gap in its tubal shape. The gap runs along its longitudinal length. The gap allows for better access to its interior for cleaning and disinfecting. In operation, the inner member translates inside the outer member in preparation for use. Moreover, the inner member translates out of the outer member in preparation for cleaning.

U.S. Patent Application Publication No. 2019/0099025 A1 describes a reusable combination corrugated drinking straw. The drinking straw has an elongated tubular body with a fluid passage running therethrough. The tubular body is manufactured from metal (e.g., stainless steel) and has a plurality of corrugations extending radially outward therefrom. The tubular body is flexible and is adapted to be bent so as to enable a user of the corrugated drinking straw to sip a beverage from a cup.

Various references describe attempts at remedying the factors contributing to the difficulties associated with single-use plastic straws. However, a need exists for a recyclable or reusable lid and straw assemblies configured to engage a container. In particular, a need exists for both a reusable and spill-proof container assembly that is dishwasher safe and a recyclable lid and straw assembly that increases the likelihood that traditionally used recycling equipment will recycle the assembly. The present invention and its embodiments relate to recyclable or reusable lid and straw assemblies. Multiple embodiments of this invention are presented in the drawings and will be described in more detail herein.

SUMMARY OF THE EMBODIMENTS

The present invention and its embodiments relate to recyclable or reusable lid and straw assemblies configured to engage a container. In particular, the present invention and its embodiments provide both a reusable and spill-proof container assembly that is dishwasher safe and a recyclable lid and straw assembly that increases the likelihood that traditionally used recycling equipment will recycle the assembly.

According to a first embodiment of the present invention, a recyclable or reusable assembly is described. The recyclable or reusable assembly includes a lid, a straw, a first sealing plug, a second sealing plug, and at least one mechanism. The lid includes a first side disposed opposite a second side and a hole located in a middle of the lid such that the hole extends through a width of the lid. The second side of the lid engages an opening of a container to form a closed container.

In general, the straw is fully extendable for use and is configured to collapse on itself in a movement. The straw has a first portion disposed opposite a second portion. The first portion of the straw has a first side disposed opposite a second side. The second portion of the straw has a first side disposed opposite a second side. The second side of the first portion of the straw is configured to engage the hole on the first side of the lid. The second side of the second portion of the straw is configured to engage the hole on the second side of the lid. The second portion of the straw resides inside of the closed container.

The first sealing plug is affixed to the first side of the first portion of the straw and the second sealing plug is affixed to the first side of the second portion of the straw such that the first sealing plug seals an inside of the first portion of the straw and the second sealing plug seals an inside of the second portion of the straw to prevent non-ingestible items from entering the first or the second portion of the straw. In some examples, the first sealing plug is screwed or secured onto the first side of the first portion of the straw and the second sealing plug is screwed or secured onto the first side of the second portion of the straw.

The at least one mechanism is configured to secure the first sealing plug and the second sealing plug to the lid or the straw. Examples of the at least one mechanism include latches, hooks, ridges, tabs, slots, threads, and/or adhesives, among others not explicitly listed herein.

In some examples, the straw comprises a collapsible configuration, a telescoping configuration, a coiled configuration, a corrugated configuration, a ball and socket configuration, a full-length configuration, or a combined telescoping and collapsible configuration. It should be appreciated that the straw is folded into a compact configuration and resides in either the first side or the second side of the lid when the straw is in a non-use position. In some examples, the lid comprises a dome configuration, a flat configuration, a substantially flat configuration, a squircle configuration, a concave configuration, a concave dome configuration, a non-flat configuration, or a bubble configuration, among other configurations not explicitly listed herein.

In some examples, the first side of the lid further comprises at least two pillar components extending away from the first side of the lid such that the first portion of the straw is receivable by an inner area formed by the first side of the lid and the at least two pillar components. Further, in other examples, the second portion of the straw and another straw and lid are receivable by the inner area formed by the first side of the lid and the at least two pillar components.

Moreover, in some examples, the lid further comprises a vent hole disposed therethrough. In additional examples, the lid also comprises a flap component configured to seal the vent hole to prevent the non-ingestible items from entering the closed container in a closed position and, in an open position, allow contents of the closed container to be vented.

A second embodiment of the present invention describes a recyclable assembly. The recyclable assembly includes a lid, a straw, a first sealing plug, a second sealing plug, and at least one mechanism. The lid includes a first side disposed opposite a second side and a hole located in a middle of the lid such that the hole extends through a width of the lid. The second side of the lid engages an opening of a container to form a closed container. The straw is fully extendable for use and is configured to collapse on itself in a movement.

The first sealing plug is affixed to the first side of the first portion of the straw. The second sealing plug is affixed to the first side of the second portion of the straw, such that the first sealing plug seals an inside of the first portion of the straw and the second sealing plug seals an inside of the second portion of the straw to prevent non-ingestible items from entering the first or the second portion of the straw. The at least one mechanism is configured to secure the first sealing plug and the second sealing plug to the lid or the straw.

In this embodiment, the straw comprises a recyclable material, such as a biodegradable plastic, a number 4 plastic, a number 6 plastic, a paper material, or another recyclable material not explicitly listed herein. In some examples, the recyclable material comprises a compostable material, such as a plant-based fiber or another compostable material. In some embodiments, the plant-based fiber comprises bagasse, which is the dry pulpy fibrous material that remains after crushing sugarcane or sorghum stalks to extract their juice.

The biologically synthesized plastic is a polyhydroxyalkanoates (PHA) plastic, a polylactic acid (PLA) plastic, a starch blend plastic, or a cellulose-based plastic, among others not explicitly listed herein. The petroleum-based plastic is a polyglycolic acid (PGA) plastic, a polybutylene succinate (PBS) plastic, a polycaprolactone (PCL) plastic, a poly(vinyl alcohol) (PVOH/PVA) plastic, or a polybutylene adipate terephthalate (PBAT) plastic, among others not explicitly listed herein. It should be appreciated that in some examples, the entire lid assembly may comprise one or more compostable materials.

In this embodiment, the straw comprises a collapsible configuration, a telescoping configuration, a coiled configuration, a corrugated configuration, a ball and socket configuration, a full-length configuration, or a combined telescoping and collapsible configuration. Moreover, in some examples, the straw includes a first portion and a second portion, where the first portion engages the first side of the lid and the second portion engages the second side of the lid and resides in the closed container. In other examples, the straw fails to engage the lid.

In some examples, the straw comprises one or more stabilizer systems located at one or more locations of the straw. Each of the one or more stabilizer systems comprises protrusions affixed to and extending away from the straw at the one or more locations. Additionally, the one or more stabilizer systems are configured to increase a width, a volume, and/or a size of the straw to allow for recyclability. Further, each of the protrusions comprise a range of motion relative to the straw. The range of motion is supported by a manual mechanism or an automatic mechanism.

Additionally, each of the one or more stabilizer systems further comprises a securement mechanism that is configured to secure the protrusions in a given or fixed position. In some examples, each of the protrusions comprise text and/or visual graphics. Further, the straw and the one or more stabilizer systems are storable in a non-use position or an in-use position in the closed container or in a recyclable wrapper.

A third embodiment of the present invention describes a reusable assembly. The reusable assembly includes a lid, a straw, a first sealing plug, a second sealing plug, and at least one mechanism. The lid includes a first side disposed opposite a second side and a hole located in a middle of the lid such that the hole extends through a width of the lid. The second side of the lid engages an opening of a container to form a closed container. The straw is fully extendable for use and is configured to collapse on itself in a movement.

The first sealing plug is affixed to the first side of the first portion of the straw and the second sealing plug is affixed to the first side of the second portion of the straw, such that the first sealing plug seals an inside of the first portion of the straw and the second sealing plug seals an inside of the second portion of the straw to prevent non-ingestible items from entering the first or the second portion of the straw. The at least one mechanism is configured to secure the first sealing plug and the second sealing plug to the lid or the straw. In some examples, the lid and the straw are manufactured as one piece.

In general, the present invention succeeds in conferring the following benefits and objectives.

It is an object of the present invention to provide a reusable lid and straw assembly, configured to engage a container, that is dishwasher safe.

It is an object of the present invention to provide a reusable lid and straw assembly, where the straw is collapsible, allowing for more efficient storage of the reusable assembly and ease of stacking multiple reusable assemblies and/or with other standard lid containers.

It is an object of the present invention to provide a recyclable lid and straw assembly, where the straw is collapsible, allowing for more efficient storage of the recyclable assembly and ease of stacking multiple recyclable assemblies and/or with other standard lid containers.

It is an object of the present invention to provide a recyclable and an environmentally friendly solution to use of a typical plastic straw.

It is an object of the present invention to provide a spill-proof container assembly.

It is an object of the present invention to provide a recyclable assembly comprising a straw affixed to a lid, where the assembly has a greater size and mass than a single plastic or recyclable straw, resulting in an increased likelihood that traditionally used recycling equipment will recycle the assembly.

DESCRIPTION OF THE PREFERRED EMBODIMENTS

Figure 1:
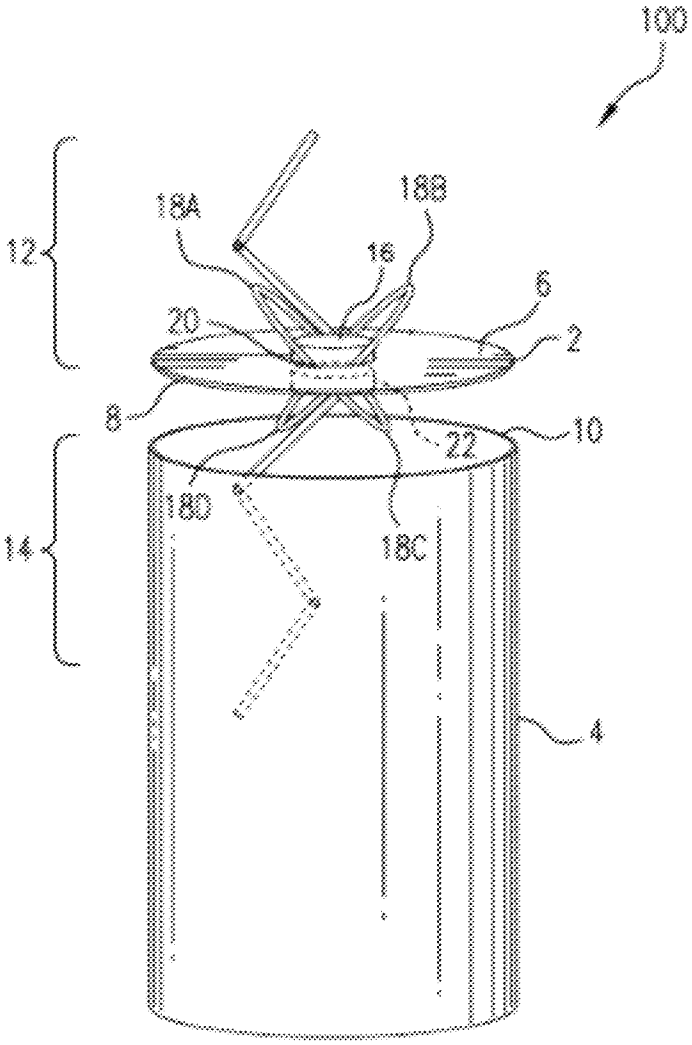
FIG. 1 is a perspective view of an embodiment of a recyclable or a reusable assembly, according to at least some embodiments described herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

According to FIG. 1, an assembly 100 may be recyclable or reusable. In a first embodiment, the assembly 100 may be the recyclable assembly. In this embodiment, the assembly 100 may include a lid 2 and a collapsible straw fully extendable for use. According to examples, the lid 2 and the collapsible straw may be manufactured as one piece. In other examples, the lid 2 and the collapsible straw may be manufactured as separate pieces. It should be appreciated that the diameter and/or radii of the collapsible straw may vary to accommodate different types of liquids. In other examples, the radii and/or diameter of the lid 2 may vary. In examples, the lid 2 may have a flat shape, a substantially flat shape, a concave shape, or a domed shape, among other examples.

In an example, the lid 2 has no opening to insert a straw or drink through, and as such, the lid 2 is spill-proof. The lid 2 may have a first side 6 disposed opposite a second side 8. The lid 2 may also have a hole 20 located in a middle of lid 2. The hole 20 is configured to extend through a width of the lid 2. In examples, the second side 8 of the lid 2 may engage an opening 10 of a container 4 to form a closed container. It should be appreciated that the shape, size, and dimensions of the container 4 are not limited to those depicted.

The collapsible straw may include a first portion 12 disposed opposite a second portion 14. The first portion 12 of the collapsible straw may be bendable or flexible and may have a first side disposed opposite a second side. The flexibility or bendability of the first portion 12 of the collapsible straw allows the first portion 12 of the collapsible straw to bend for ease of use by someone who cannot reach the collapsible straw in a straight and an extended use position.

The first side of the first portion 12 of the collapsible straw may be configured to engage the hole 20 on the first side 6 of the lid 2. A user may place his/her lips on a second side of the first portion 12 of the collapsible straw to drink a liquid from the container 4. The closed container may house a liquid of any temperature.

The second portion 14 of the collapsible straw may include a first side disposed opposite a second side. The first side of the second portion 14 of the collapsible straw may be configured to engage the hole 20 on the second side 8 of the lid 2. The second side of the second portion 14 of the collapsible straw may reside inside of the closed container.

In some examples, the first portion 12 and the second portion 14 of the collapsible straw may comprise a recyclable material. In examples, the recyclable material may be: a biodegradable plastic (such as a biologically synthesized plastic and a petroleum-based plastic). A non-exhaustive list of the biologically synthesized plastic includes: a polyhydroxyalkanoates (PHA) plastic, a polylactic acid (PLA) plastic, a starch blend plastic, and a cellulose-based plastic. A non-exhaustive list of the petroleum-based plastic includes: a polyglycolic acid (PGA) plastic, a polybutylene succinate (PBS) plastic, a polycaprolactone (PCL) plastic, a poly(vinyl alcohol) (PVOH/PVA) plastic, and a polybutylene adipate terephthalate (PBAT) plastic.

The recyclable material of the collapsible straw may also include: a number 1 plastic (such as polyethylene terephthalate), a number 2 plastic (such as a high-density polyethylene), a number 3 plastic (such as a polyvinyl chloride), a number 4 plastic (such as a low-density polyethylene (LDPE) plastic), a number 5 plastic (e.g., polypropylene), a number 6 plastic (such as a PLA plastic or a polystyrene plastic), a number 7 plastic (e.g., BPA, polycarbonate, and LEXAN), a paper material, and combinations of these materials. In other examples, the lid 2 may comprise a biodegradable plastic, a number 4 plastic, a number 6 plastic, a paper material, a recyclable material, and combinations thereof. It should be appreciated that the recyclable material of the first portion 12 and the second portion 14 of the collapsible straw and the material comprising the lid 2 are not limited to the examples explicitly described herein.

In examples, the assembly 100 may additionally include a first sealing plug 16 affixed to the first side 6 of the lid 2 and a second sealing plug 22 affixed to the second side 8 of the lid 2. The first sealing plug 16 and the second sealing plug 22 are depicted in closed positions in FIG. 2, FIG. 3, FIG. 5 and FIG. 7 and are depicted in open positions in FIG. 6 and FIG. 8. The first sealing plug 16 and the second sealing plug 22 are both tamper-evident caps that provide a resealable closure.

In examples, the first sealing plug 16 is configured to screw onto or into the first portion 12 of the collapsible straw and the second sealing plug 22 is configured to screw onto or into the second portion 14 of the collapsible straw. The first sealing plug 16 is configured to seal an inside of the first portion 12 of the collapsible straw and the second sealing plug 22 is configured to seal an inside of the second portion 14 of the collapsible straw to prevent non-ingestible items, such as dirt, from entering the first portion 12 of the second portion 14 of the collapsible straw. In examples, the first sealing plug 16 is removable from the first portion 12 of the collapsible straw and the second sealing plug 22 is removable from the second portion 14 of the collapsible straw.

In further examples, and as depicted in FIG. 1, FIG. 2, FIG. 3, FIG. 5, FIG. 6, FIG. 7, and FIG. 8, the first sealing plug 16 comprises one or more pull tabs 18A, 18B and the second sealing plug 22 comprises one or more pull tabs 18C, 18D. The first sealing plug 16, the second sealing plug 22, and the one or more pull tabs 18A, 18B, 18C, 18D comprise a recyclable material.

Figure 6:
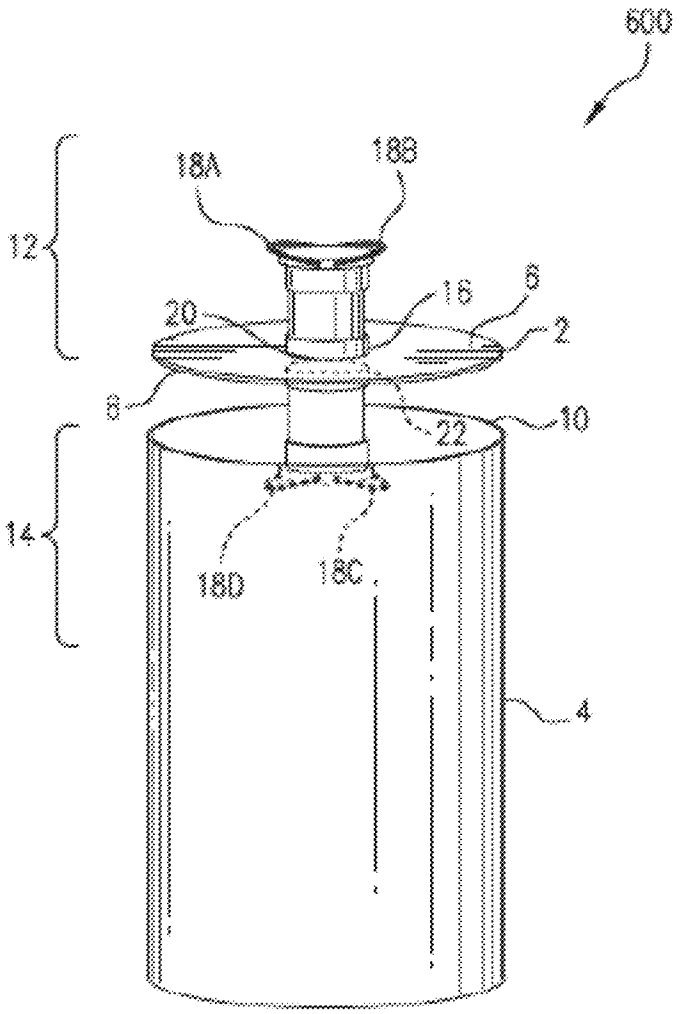
FIG. 6 depicts a perspective view of an embodiment of a first and a second sealing plug in an open position, according to at least some embodiments described herein.
Figure 7:
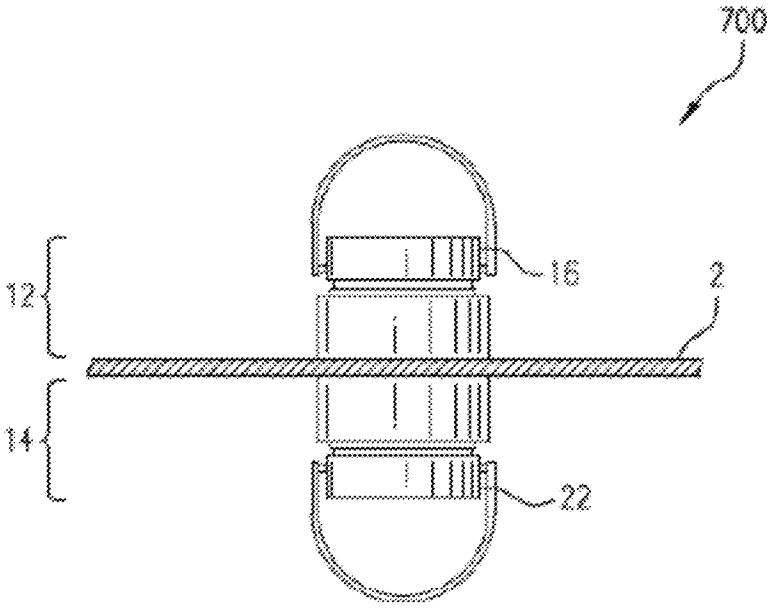
FIG. 7 depicts a perspective view of an embodiment of a first and a second sealing plug in a closed position, according to at least some embodiments described herein.
Figure 8:
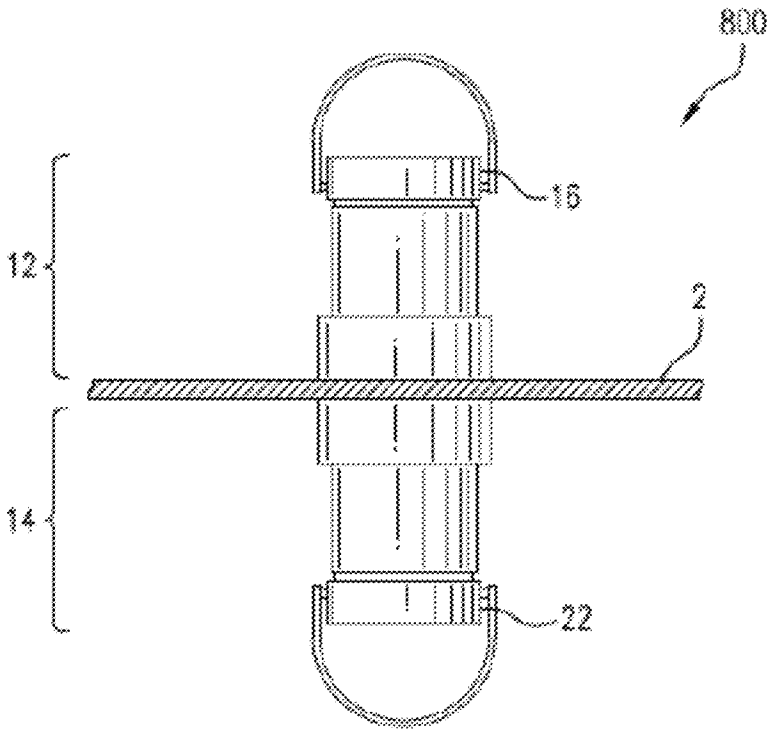
FIG. 8 depicts a perspective view of an embodiment of a first and a second sealing plug in an open position, according to at least some embodiments described herein.

The first sealing plug 16 and the second sealing plug 22 may be in a closed position when a user is not engaging with the closed container (as shown in FIG. 2, FIG. 3, FIG. 5 and FIG. 7). This closed position ensures that non-ingestible items do not enter the collapsible straw or the container 4. If the user wishes to drink from the closed container, the user may pull the one or more pull tabs 18A, 18B of the first sealing plug 16 away from the first side 6 of the lid 2 and the one or more pull tabs 18C, 18D of the second sealing plug 22 away from the second side 8 of the lid 2 to extend the first sealing plug 16 and the second sealing plug 22 to an open position. When the first sealing plug 16 and the second sealing plug 22 are in the open position (as shown in FIG. 6 and FIG. 8), the first portion 12 and the second portion 14 of the collapsible straw are configured in an extended use position, allowing the user to drink from the closed container.

Figure 2:
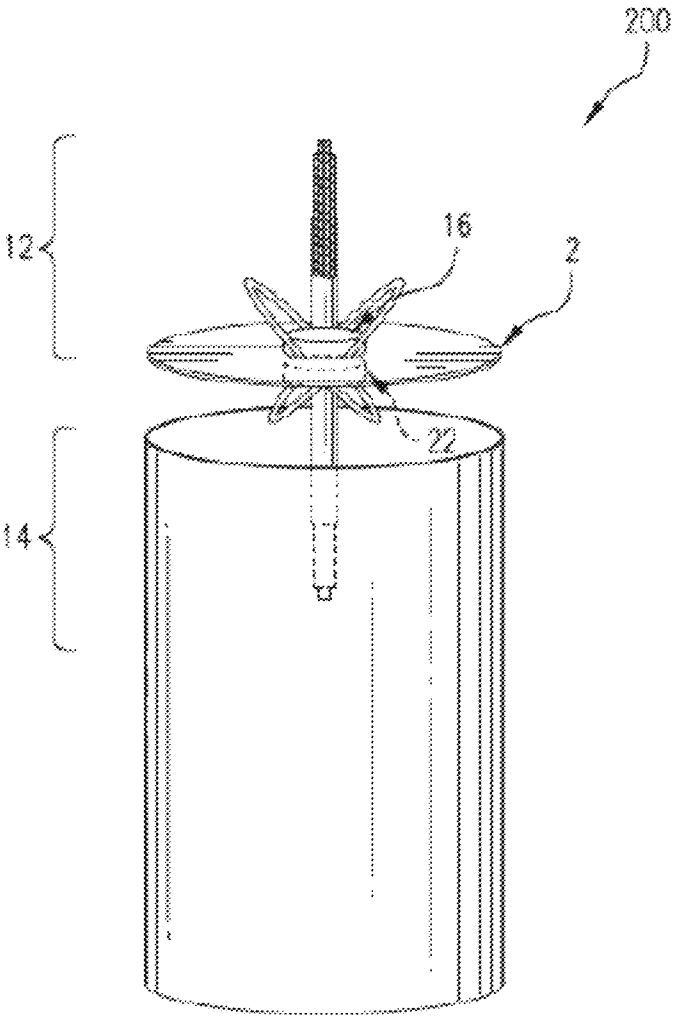
FIG. 2 depicts a perspective view of an embodiment of a telescoping straw in a closed position and a first and a second sealing plug in a closed position, according to at least some embodiments described herein.

Once the user is done engaging with the closed container, the user can push the one or more pull tabs 18A, 18B of the first sealing plug 16 towards the first side 6 of the lid 2 and the one or more pull tabs 18C, 18D of the second sealing plug 22 towards the second side 8 of the lid 2 to condense the first sealing plug 16 and the second sealing plug 22 to a closed position for travel or storage. In the closed position, the first portion 12 and the second portion 14 of the collapsible straw are configured in a collapsed non-use position, disallowing the user to drink from the closed container. In the collapsed non-use position, the collapsible straw may be folded into a compact configuration and may reside against the lid 2 (as shown in FIG. 1). Moreover, in some examples, the collapsible straw may collapse on itself in a telescoping movement (as shown in FIG. 2) when in the collapsed non-use position.

The collapsible straw comprises a rigid external tube and a flexible internal tubing that is foldable to the compact configuration for storage. In the folded configuration, the collapsible straw has a reduced length of approximately one-half to one-fourth of its extended length when in use. However, the reduced length of the collapsible straw is not limited to the lengths explicitly described herein and other lengths are contemplated by Applicant.

Figure 3:
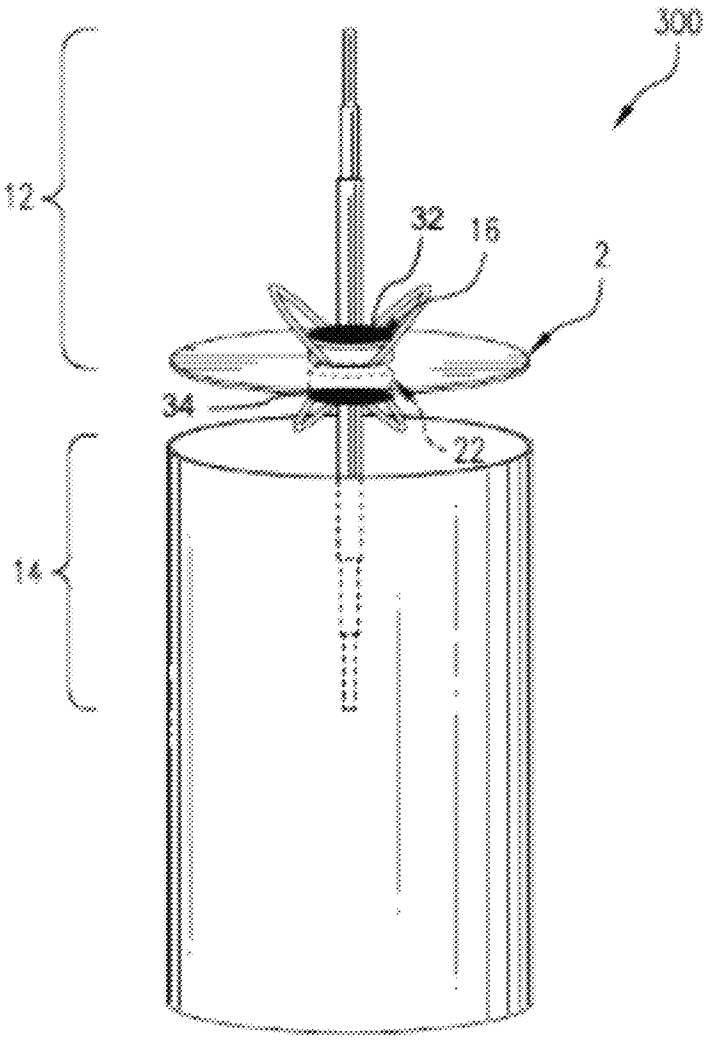
FIG. 3 depicts a perspective view of an embodiment of a telescoping straw in an open position and a first and a second sealing plug in a closed position, according to at least some embodiments described herein.

In some examples, and as shown in FIG. 3, a first sanitary film 32 may be affixed to the first sealing plug 16 and a second sanitary film 34 may be affixed to the second sealing plug 22. The first sanitary film 32 and the second sanitary film 34 may comprise a plastic material. When the user pulls the one or more pull tabs 18A, 18B of the first sealing plug 16 away from the first side 6 of the lid 2 and the one or more pull tabs 18C, 18D of the second sealing plug 22 away from the second side 8 of the lid 2 to extend the first sealing plug 16 and the second sealing plug 22 to the open position, the first sanitary film 32 and the second sanitary film 34 may be removed. In other examples, the first sanitary film 32 and the second sanitary film 34 may be removed directly via user action.

Figure 9:
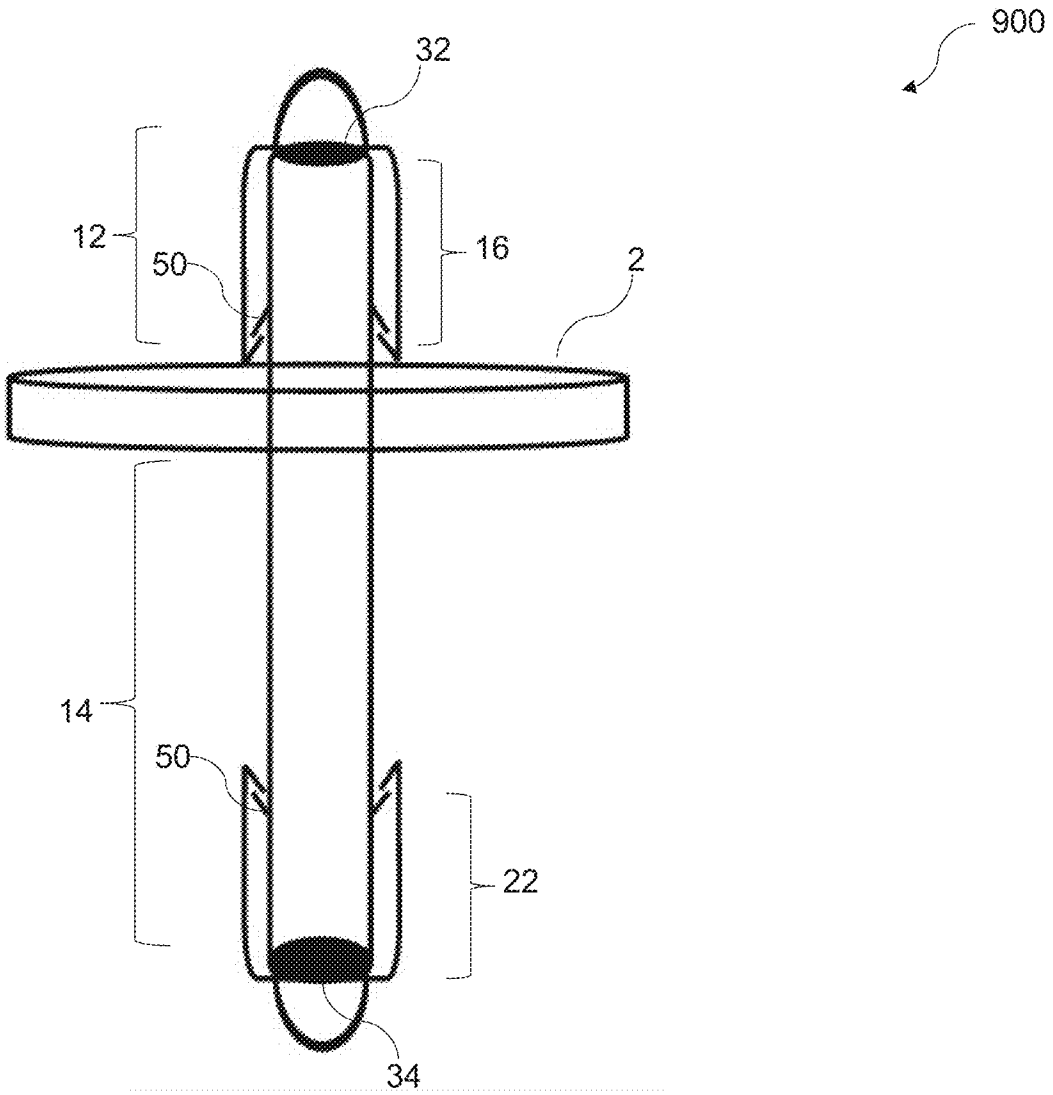
FIG. 9 depicts a perspective view of an embodiment of a first and a second sealing plug with covers, according to at least some embodiments described herein.

Additional configurations of the first sealing plug 16 and the second sealing plug 22 are contemplated by Applicant herein. For example, FIG. 9 depicts another embodiment 900 of the first sealing plug 16 and the second sealing plug 22 having the first sanitary film 32 and the second sanitary film 34, respectively. In some examples, at least one mechanism may be used to secure the first sealing plug 16 and the second sealing plug 22 to the lid 2 or the straw, such as latches, hooks, ridges, tabs, slots, threads, and/or adhesives. As shown in FIG. 9, threads may be disposed on an outside of the collapsible straw, which interact with a locking tab portion 50 of the first sealing plug 16 and the second sealing plug 22 to maintain a position of the first sealing plug 16 and the second sealing plug 22. In other examples, and as depicted in FIG. 9, the threads may be configured as tabs or tab components.

Figure 10:
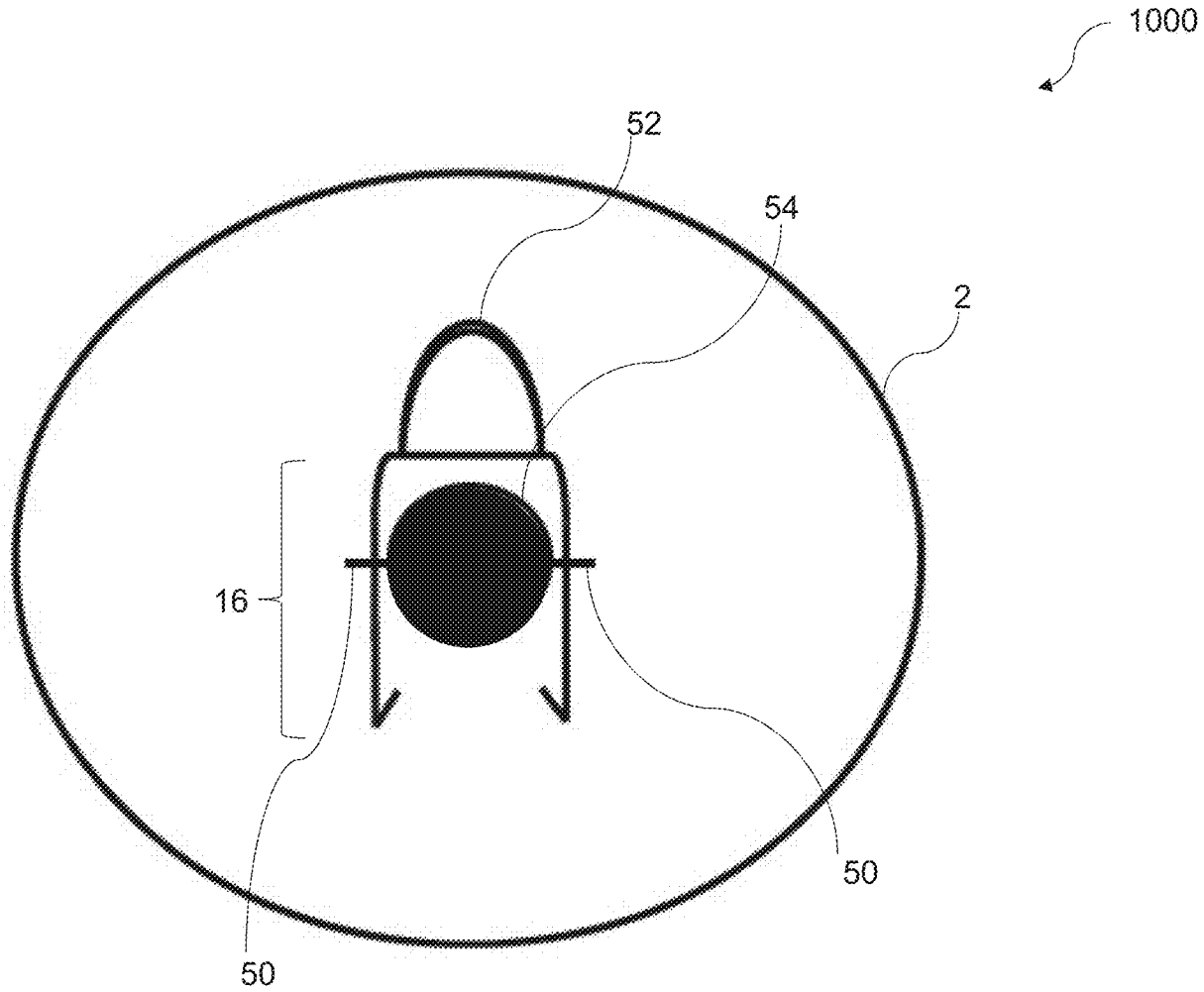
FIG. 10 depicts a top down view of an embodiment of a first and a second sealing plug with covers affixed to a lid, according to at least some embodiments described herein.

Moreover, FIG. 10 depicts a top down view 1000 of the other embodiment 900 of FIG. 9 of the first sealing plug 16 affixed to the lid 2 and the first sanitary film 32. FIG. 10 also depicts a sealing plug loop component 52, the locking tab portion 50, and the collapsible straw 54. When the collapsible straw 54 is extended, the first sealing plug 16 is removed. In the recyclable embodiment, once the first sealing plug 16 or the second sealing plug 22 is removed from the extended straw, the first sealing plug 16 and/or the second sealing plug 22 is secured or affixed to the lid assembly so that the entire assembly with the first sealing plug 16 and/or the second sealing plug 22 can be recycled. In the reusable embodiment, the first sealing plug 16 or the second sealing plug 22 may be secured in this way and removed when necessary.

In another embodiment, the assembly 100 may comprise a reusable assembly. The reusable assembly may include the same components or substantially the same components described supra with regards to the recyclable assembly. In some examples, the reusable assembly may be housed inside of an enclosed cylinder prior to use to ensure a sanitary condition of the reusable assembly.

In examples, the reusable assembly may comprise a silicone material such that the assembly 100 is dishwasher safe. For example, the first portion 12 and the second portion 14 of the collapsible straw may be fully extendable in the open position to stabilize the reusable assembly in a dishwasher rack during washing. In other examples, the first portion 12 of the collapsible straw may be in the collapsed non-use position or the folded state when placed on the dishwasher rack during washing. In another example, the second portion 14 of the collapsible straw in the collapsed non-use position or the folded state when placed on the dishwasher rack during washing. It should be appreciated that any configuration of the first portion 12 and the second portion 14 of the collapsible straw is contemplated when the reusable assembly is placed on the dishwasher rack during washing. Moreover, it should be appreciated that the collapsibility of the collapsible straw allows for more efficient storage of the reusable assembly by allowing for stacking of multiple reusable assemblies and/or with other standard lid containers.

Figure 4A:
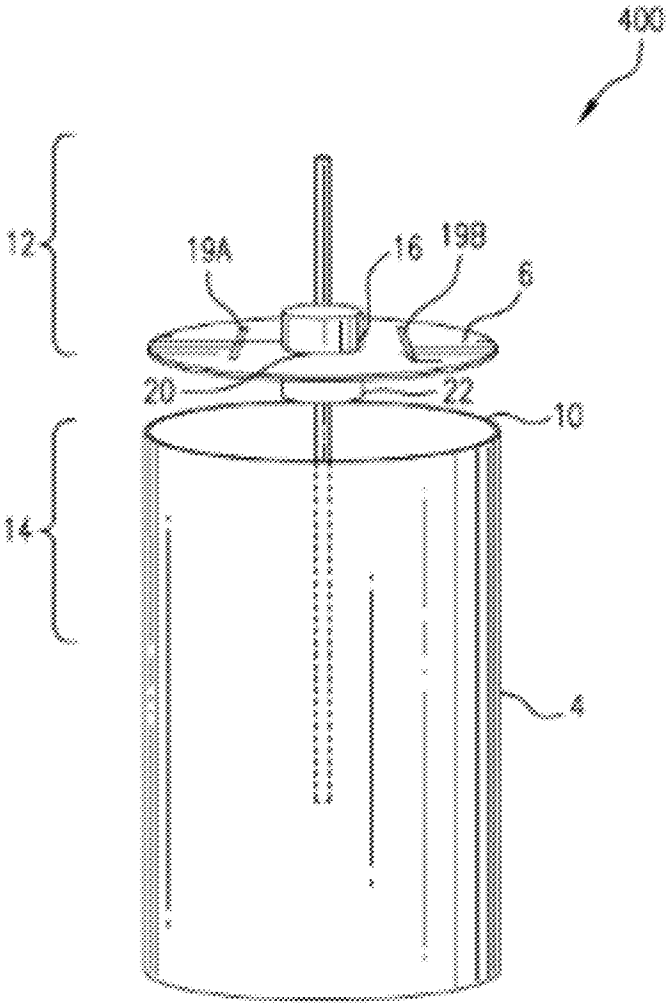
FIG. 4A depicts a perspective view of a preferred embodiment of a collapsible straw, one or more latches, and a first and a second sealing plug in an open position, according to at least some embodiments described herein.
Figure 4B:
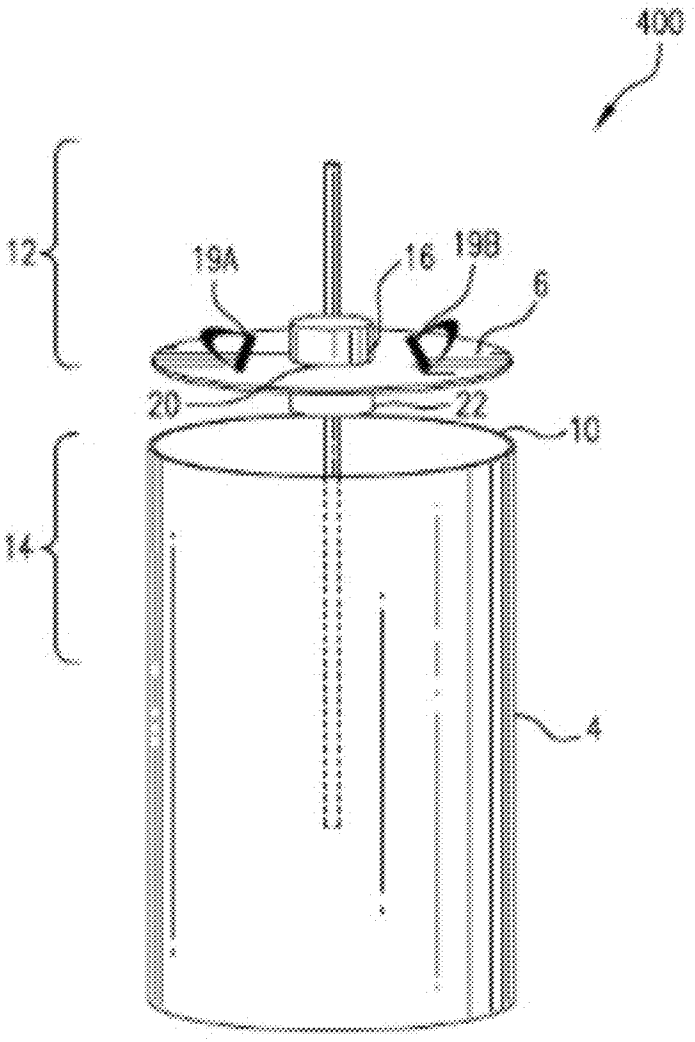
FIG. 4B depicts another perspective view of a preferred embodiment of a collapsible straw, one or more hooks, and a first and a second sealing plug in an open position, according to at least some embodiments described herein.
Figure 5:
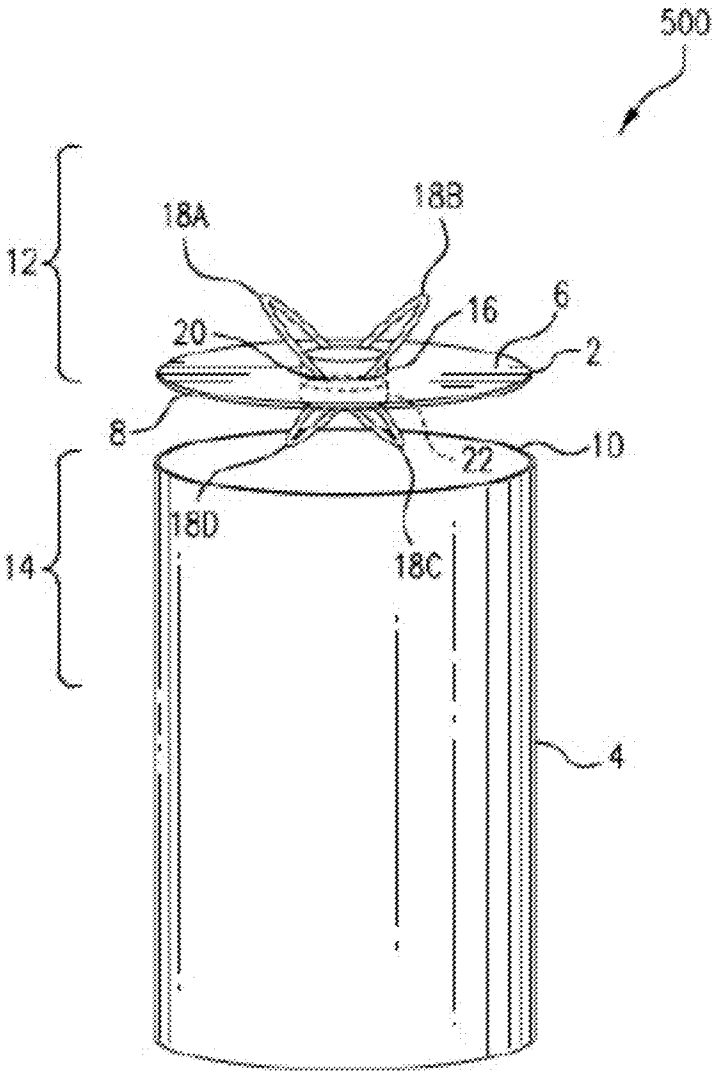
FIG. 5 depicts a perspective view of an embodiment of a first and a second sealing plug in a closed position, according to at least some embodiments described herein.

In some examples, the first sealing plug 16 and/or the second sealing plug 22 are removable from the assembly. Once removed, the first sealing plug 16 and/or the second sealing plug 22 may be recycled. In other examples, the first sealing plug 16 and/or the second sealing plug 22 may be reusable. In this example, the lid 2 may comprise one or more latches (of FIG. 4A) or hooks (of FIG. 4B) 19A, 19B. The one or more latches (of FIG. 4A) or hooks (of FIG. 4B) 19A, 19B may hold or secure the reusable first sealing plug 16 and the second sealing plug 22 to the lid 2. In other examples, the first sealing plug 16 and/or the second sealing plug 22 are not removable from the assembly, and as such, the first sealing plug 16, the second sealing plug 22, the collapsible straw, and the lid 2 may be reused or recycled as one assembly.

Figure 11:
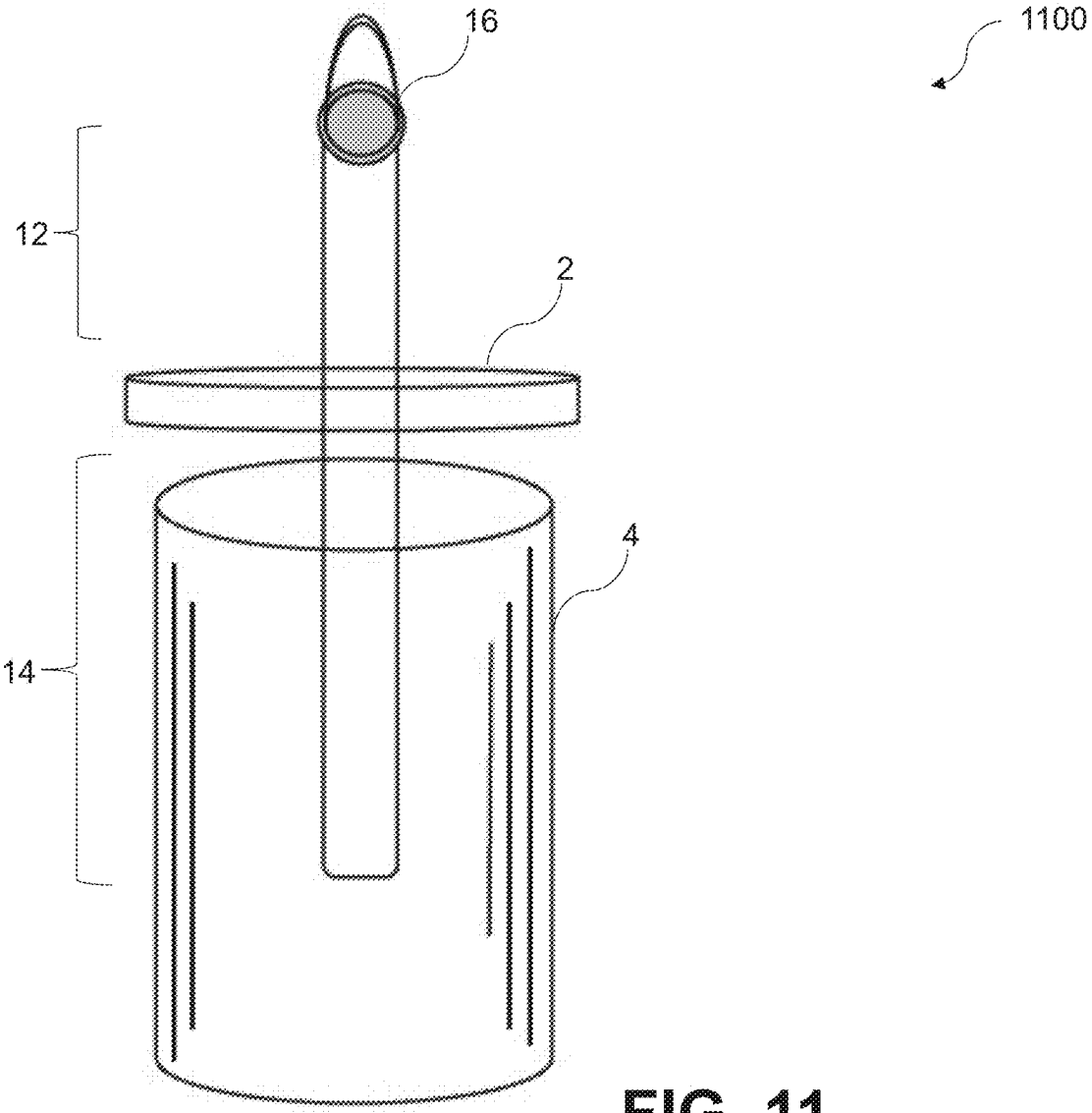
FIG. 11 depicts a perspective view an embodiment of a recyclable assembly, according to at least some embodiments described herein.
Figure 22:
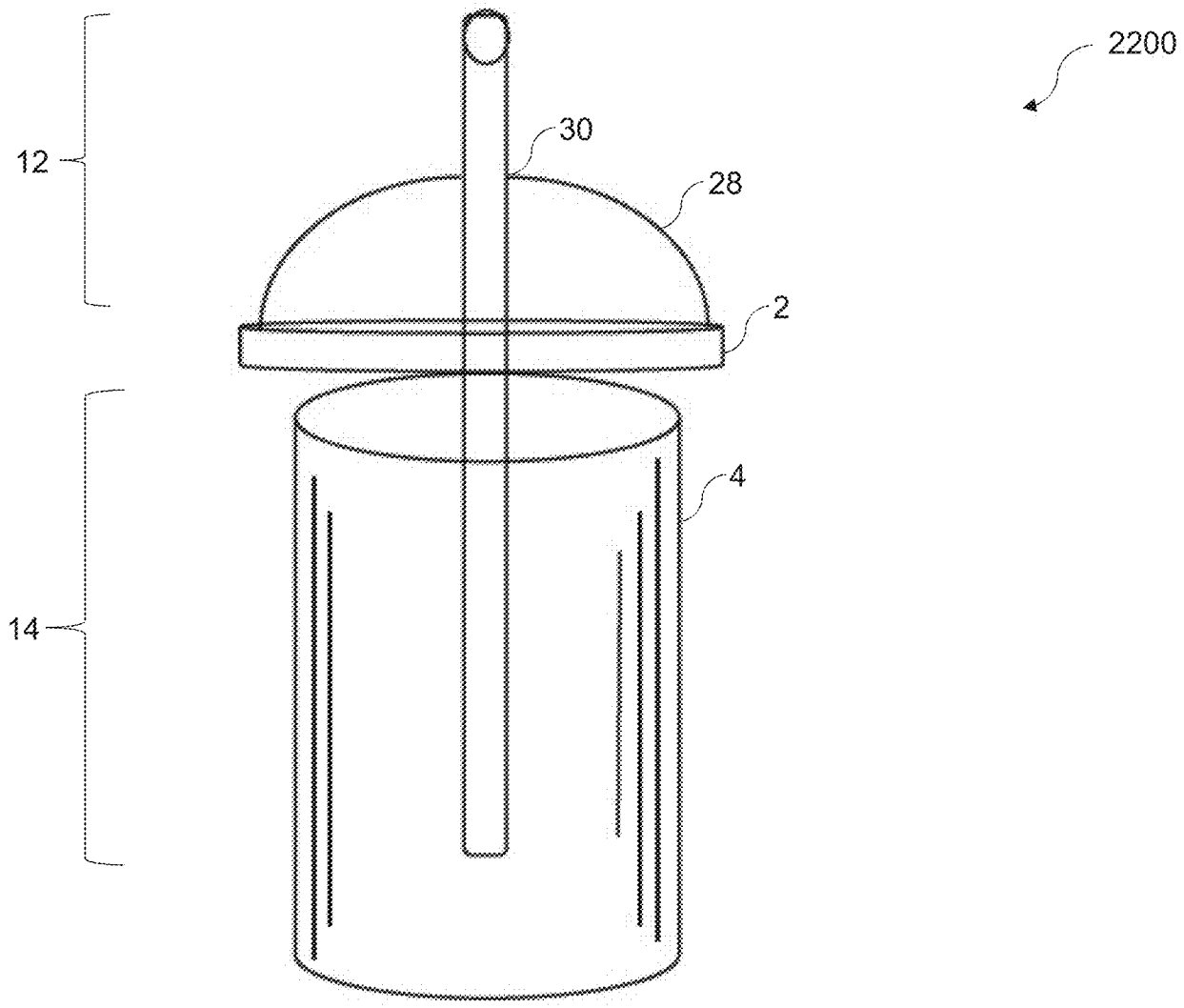
FIG. 22 depicts a perspective view of an embodiment of a dome shaped lid of a recyclable or a reusable assembly, according to at least some embodiments described herein.
Figure 23:
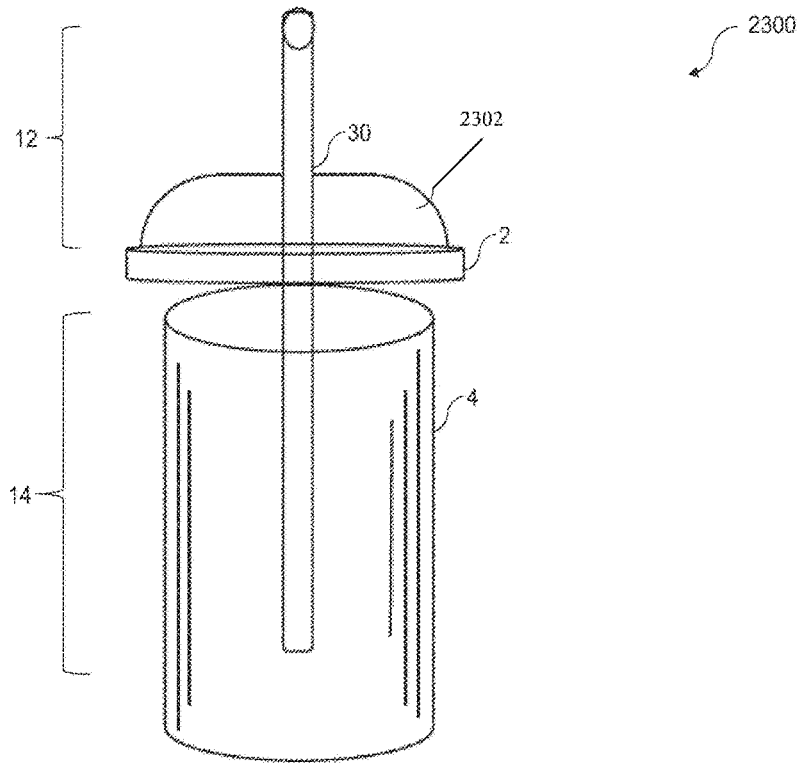
FIG. 23 depicts a perspective view of an embodiment of a half-shaped dome shaped lid of a recyclable or a reusable assembly, according to at least some embodiments described herein.
Figure 24:
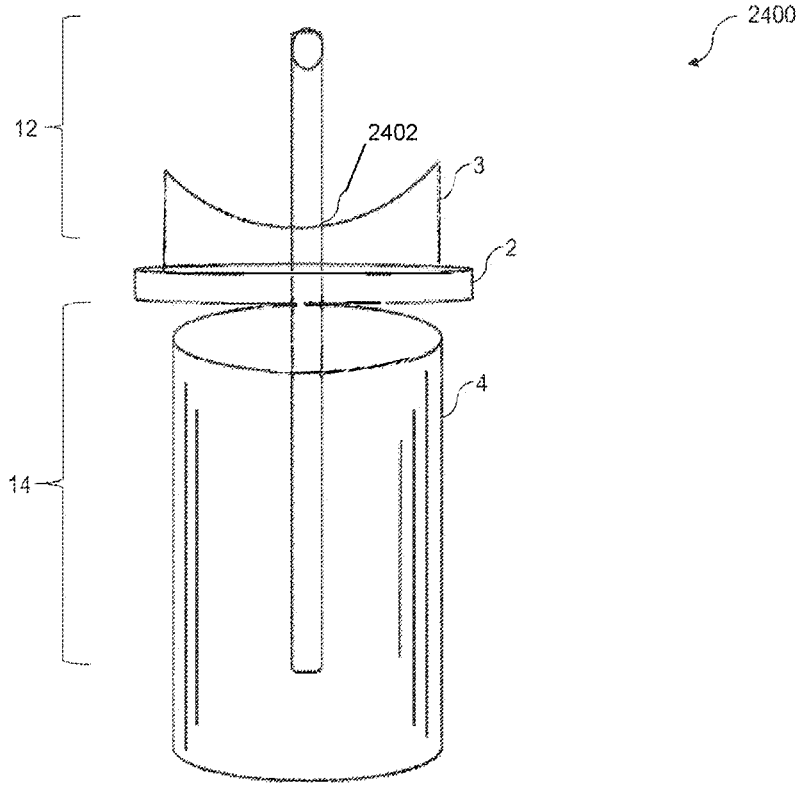
FIG. 24 depicts a perspective view of an embodiment of a concave-shaped dome lid of a recyclable or a reusable assembly, according to at least some embodiments described herein.

The above-referenced disclosure describes one or more embodiments of the instant invention. FIG. 4 depicts a preferred embodiment of the instant invention. In this embodiment, an assembly 400 is depicted, which may be recyclable or reusable. For example, FIG. 11 depicts an embodiment 1100 of the recyclable assembly. The assembly 400 may comprise a lid 2 and a collapsible straw fully extendable for use. In examples, the lid 2 may have a flat shape, a substantially flat shape, a squircle shape 2302 (of FIG. 23), a concave shape, a concave domed shape 2402 (of FIG. 24), a dome shape 28 (of FIG. 22), or a bubble shape, among other examples.

The lid 2 may have a first side 6 disposed opposite a second side 8. The lid 2 may also have a hole 20 located in a middle of lid 2. The hole 20 is configured to extend through a width of the lid 2. In examples, the second side 8 of the lid 2 may engage an opening 10 of a container 4 to form a closed container. The closed container may house a liquid of any temperature. It should be appreciated that the shape, size, and dimensions of the container 4 are not limited to those depicted.

The collapsible straw may include a first portion 12 disposed opposite a second portion 14. The first portion 12 of the collapsible straw may be bendable or flexible and may have a first side disposed opposite a second side. The flexibility or bendability of the first portion 12 of the collapsible straw allows the first portion 12 of the collapsible straw to bend for ease of use by someone who cannot reach the collapsible straw in a straight and an extended use position. The second portion 14 of the collapsible straw may have a first side disposed opposite a second side.

The first side of the first portion 12 of the collapsible straw is configured to be engaged by a mouth of the user. The second side of the first portion of the collapsible straw is configured to engage the hole 20 on the first side 6 of the lid 2. The first side of the second portion 14 of the collapsible straw is configured to be housed within the closed container. The second side of the second portion 14 of the collapsible straw is configured to engage hole 20 on the second side 8 of the lid 2.

In some examples, the straw may have a corrugated flex pipe configuration. In this example, as depicted, the second side of the first portion 12 of the straw may have a larger width than the first side of the first portion 12 of the straw. Moreover, the second side of the second portion 14 of the straw may have a larger width than the first side of the first portion 12 of the straw.

Differing from the above-referenced examples, the assembly 400 may additionally include a first sealing plug 16 affixed to the first side of the first portion 12 of the collapsible straw and may include a second sealing plug 22 affixed to the first side of the second portion 14 of the collapsible straw. The first sealing plug 16 and the second sealing plug 22 are both tamper-evident caps that provide a resealable closure. The first sealing plug 16 seals an inside of the first portion 12 of the straw and the second sealing plug 22 seals an inside of the second portion 14 of the straw to prevent non-ingestible items from entering the first portion 12 or the second portion 14 of the straw.

It should be appreciated that the first sealing plug 16 may be manufactured to be removable from the assembly 400. In other examples, the first sealing plug 16 may be screwed or secured onto the first side of the first portion 12 of the straw. Moreover, the second sealing plug 22 may be screwed or secured onto the first side of the second portion 14 of the straw. The first portion 12 of the straw may collapse on itself in a direction moving towards the first side 6 of the lid 2. Moreover, the second portion 14 of the straw may collapse on itself in a direction moving towards the second side 8 of the lid 2.

The first sealing plug 16 and the second sealing plug 22 may be in a closed position when a user is not engaging with the closed container. This closed position ensures that non-ingestible items do not enter the collapsible straw or the container 4. If the user wishes to drink from the closed container, the user may pull the one or more pull tabs 18A, 18B of the first sealing plug 16 away from the first side 6 of the lid 2 and the one or more pull tabs 18C, 18D of the second sealing plug 22 away from the second side 8 of the lid 2 to extend the first sealing plug 16 and the second sealing plug 22 to an open position. When in the open position (as shown in FIG. 3, FIG. 6, FIG. 8, and FIG. 16), the first portion 12 and the second portion 14 of the collapsible straw are configured in an extended use position, allowing the user to drink from the closed container.

Once the user is done engaging with the closed container, the user can push the one or more pull tabs 18A, 18B of the first sealing plug 16 towards the first side 6 of the lid 2 and the one or more pull tabs 18C, 18D of the second sealing plug 22 towards the second side 8 of the lid 2 to condense the first sealing plug 16 and the second sealing plug 22 to a closed position for travel or storage. In the closed position, the first portion 12 and the second portion 14 of the collapsible straw are configured in a collapsed non-use position, disallowing the user to drink from the closed container. In some examples, in this collapsed non-use position, the first sealing plug 16 houses the first portion 12 of the straw and the second sealing plug 22 houses the second portion 14 of the straw.

As has been explained, in some examples, the first sealing plug 16 and/or the second sealing plug 22 are removable from the assembly. Once removed, the first sealing plug 16 and/or the second sealing plug 22 may be recycled. In other examples, the first sealing plug 16 and/or the second sealing plug 22 may be reusable. In this example, the lid 2 may comprise one or more latches (of FIG. 4A) or hooks (of FIG. 4B) 19A, 19B. The one or more latches (of FIG. 4A) or hooks (of FIG. 4B) 19A, 19B may hold or secure the reusable first sealing plug 16 and the second sealing plug 22 to the lid 2. In other examples, the first sealing plug 16 and/or the second sealing plug 22 are not removable from the assembly, and as such, the first sealing plug 16, the second sealing plug 22, the collapsible straw, and the lid 2 may be reused or recycled as one assembly.

Figure 12:
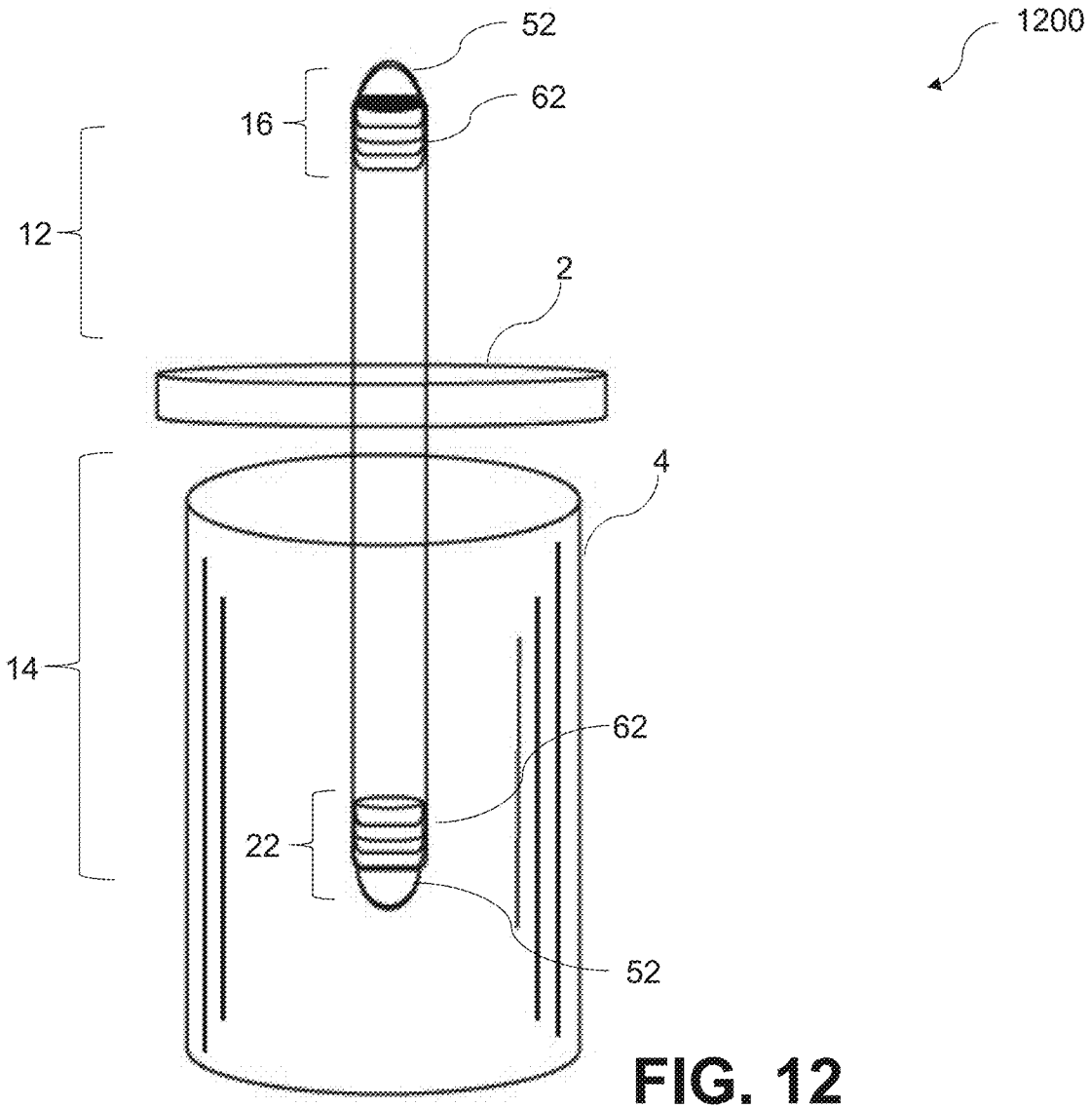
FIG. 12 depicts a perspective view an embodiment of a reusable or recyclable sealing plug, according to at least some embodiments described herein.
Figure 13:
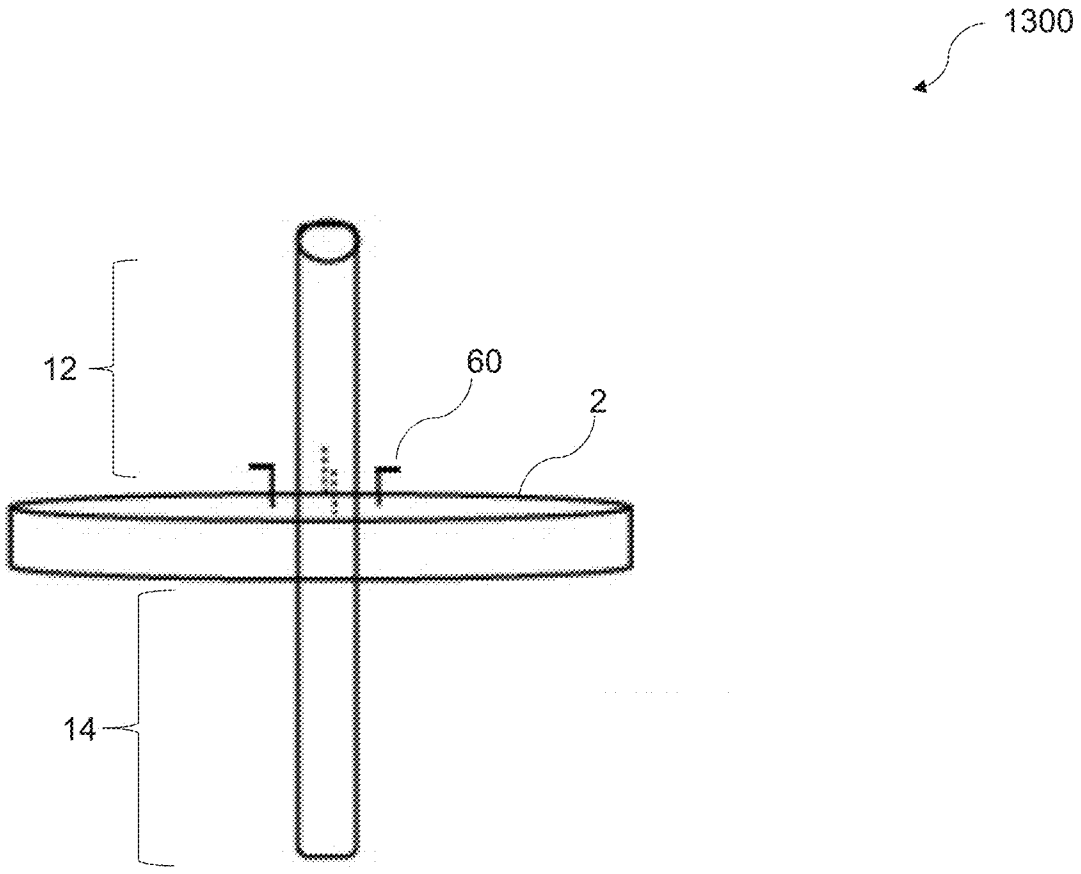
FIG. 13 depicts a side view an embodiment of a reusable or recyclable sealing plug, according to at least some embodiments described herein.
Figure 14:
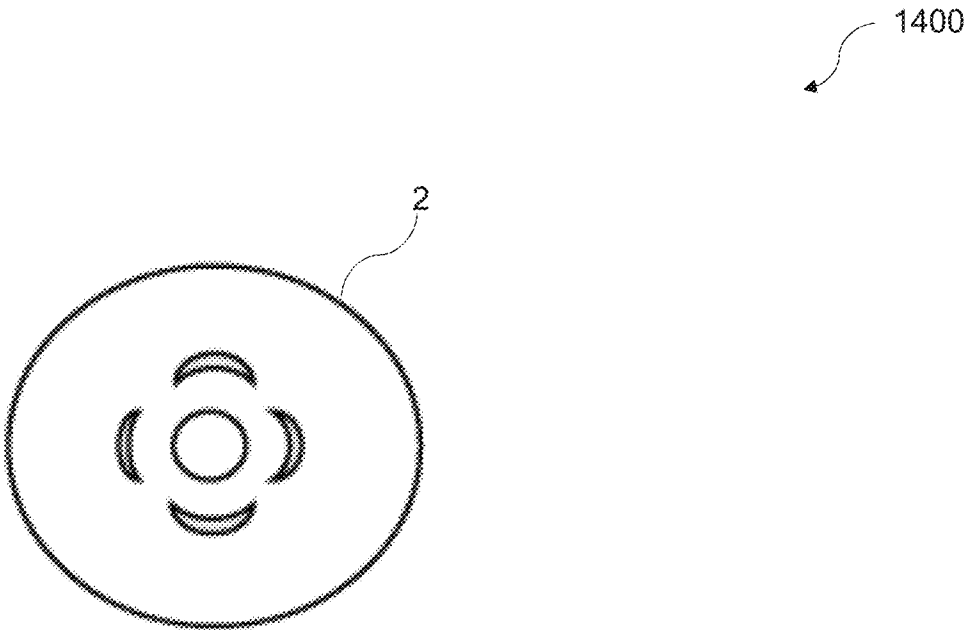
FIG. 14 depicts a top down view of an embodiment of a sealing plug locking mechanism upon which FIG. 15 attaches, according to at least some embodiments described herein.
Figure 15:
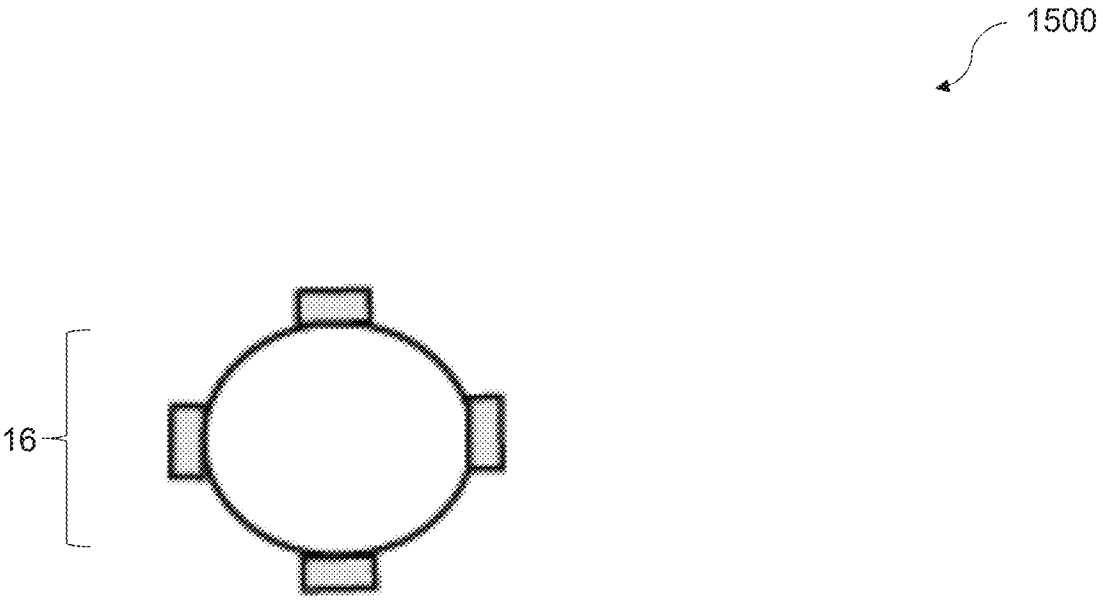
FIG. 15 depicts a top down view of an embodiment of a reusable or recyclable sealing plug, according to at least some embodiments described herein.
Figure 16:
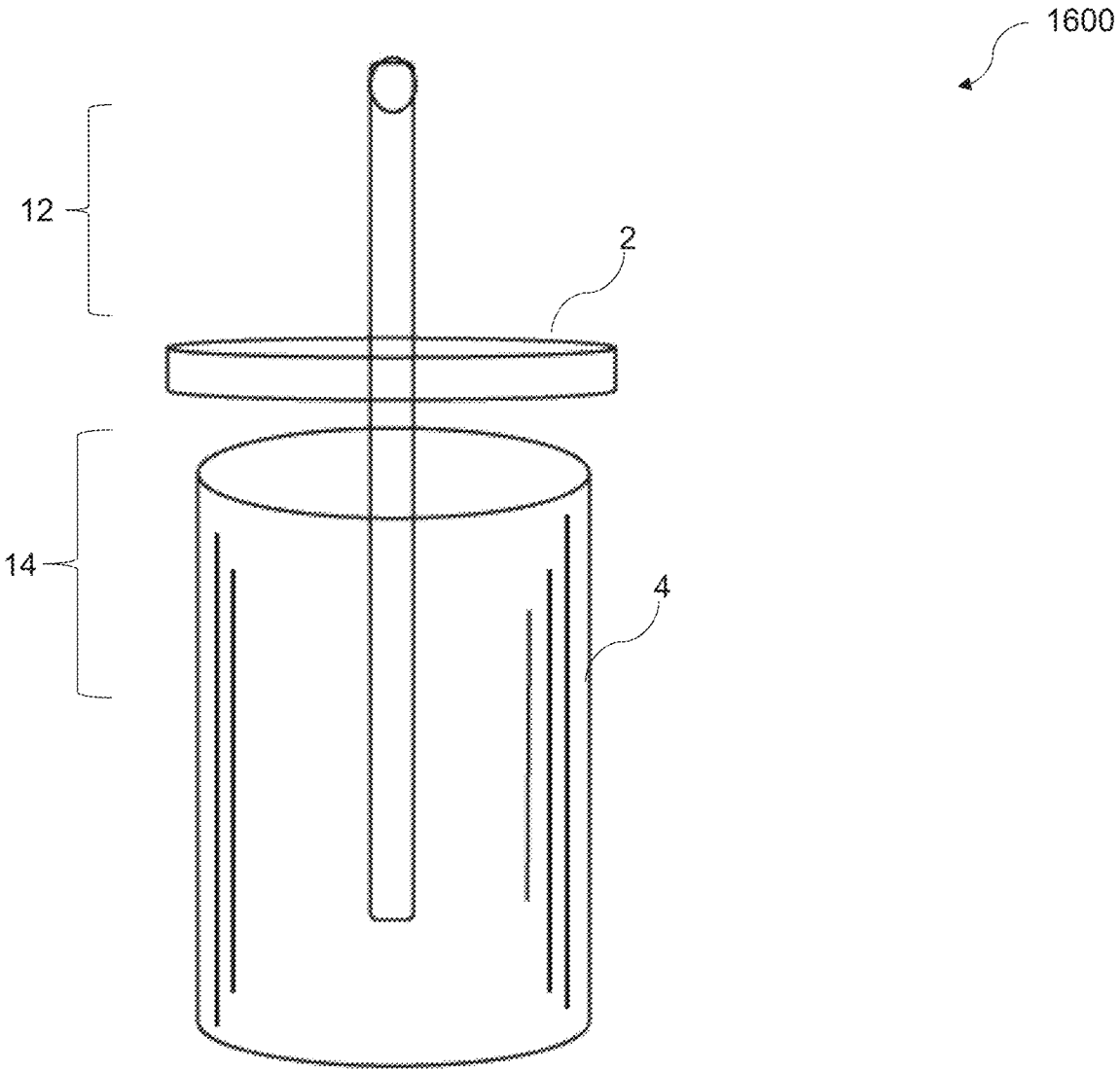
FIG. 16 depicts a perspective view of an embodiment of a recyclable or a reusable assembly having a straw in a fully extended position, according to at least some embodiments described herein.

Additionally, FIG. 12 depicts a perspective view an embodiment 1200 of a reusable or recyclable sealing plug (e.g., the first sealing plug 16 and the second sealing plug 22). FIG. 12 also depicts the sealing plug loop component 52, as well as threads 62 of the first sealing plug 16 and the second sealing plug 22. FIG. 13 depicts a side view an embodiment 1300 of the reusable or recyclable sealing plug (e.g., the first sealing plug 16 and the second sealing plug 22), as well as a locking slot 60. FIG. 14 depicts a top down view of an embodiment of a sealing plug locking mechanism upon which FIG. 15 attaches, according to at least some embodiments described herein. FIG. 15 depicts a top down view of an embodiment 1500 of the reusable or recyclable sealing plug (e.g., the first sealing plug 16 and the second sealing plug 22).

Figure 17:
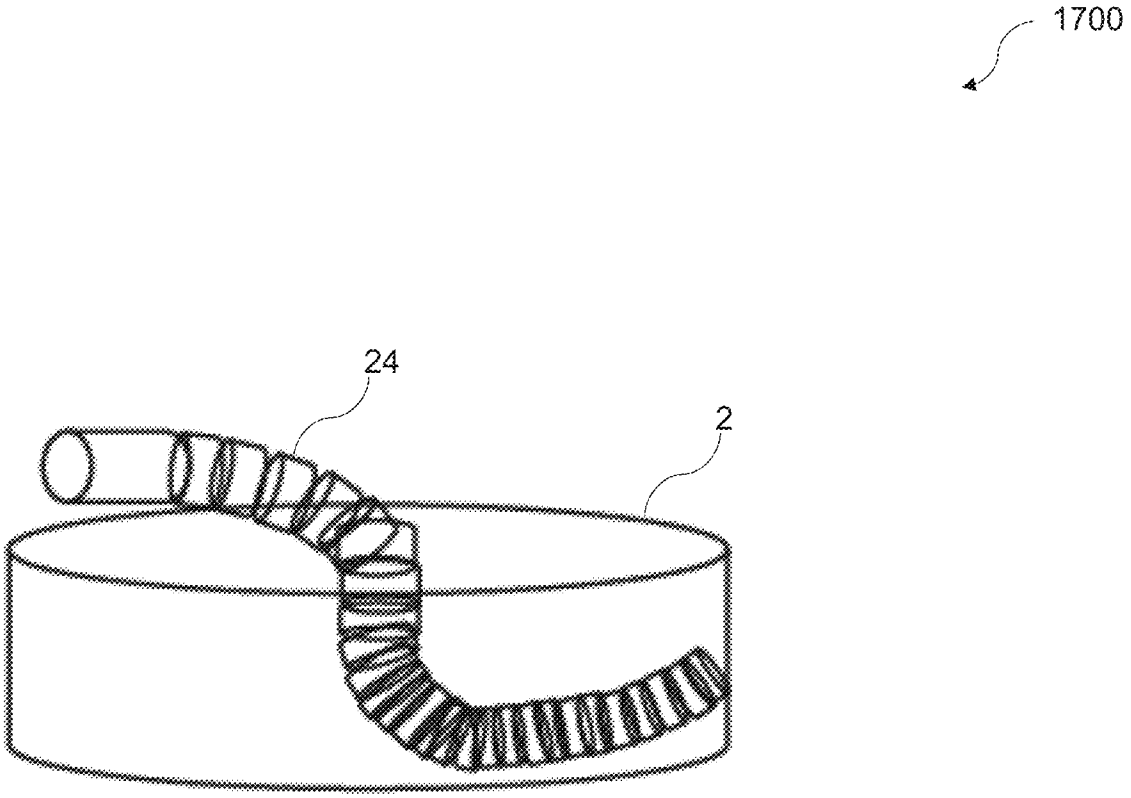
FIG. 17 depicts a side view of an embodiment of a coiled or corrugated configuration of a straw and a lid of a recyclable or a reusable assembly, according to at least some embodiments described herein.
Figure 18:
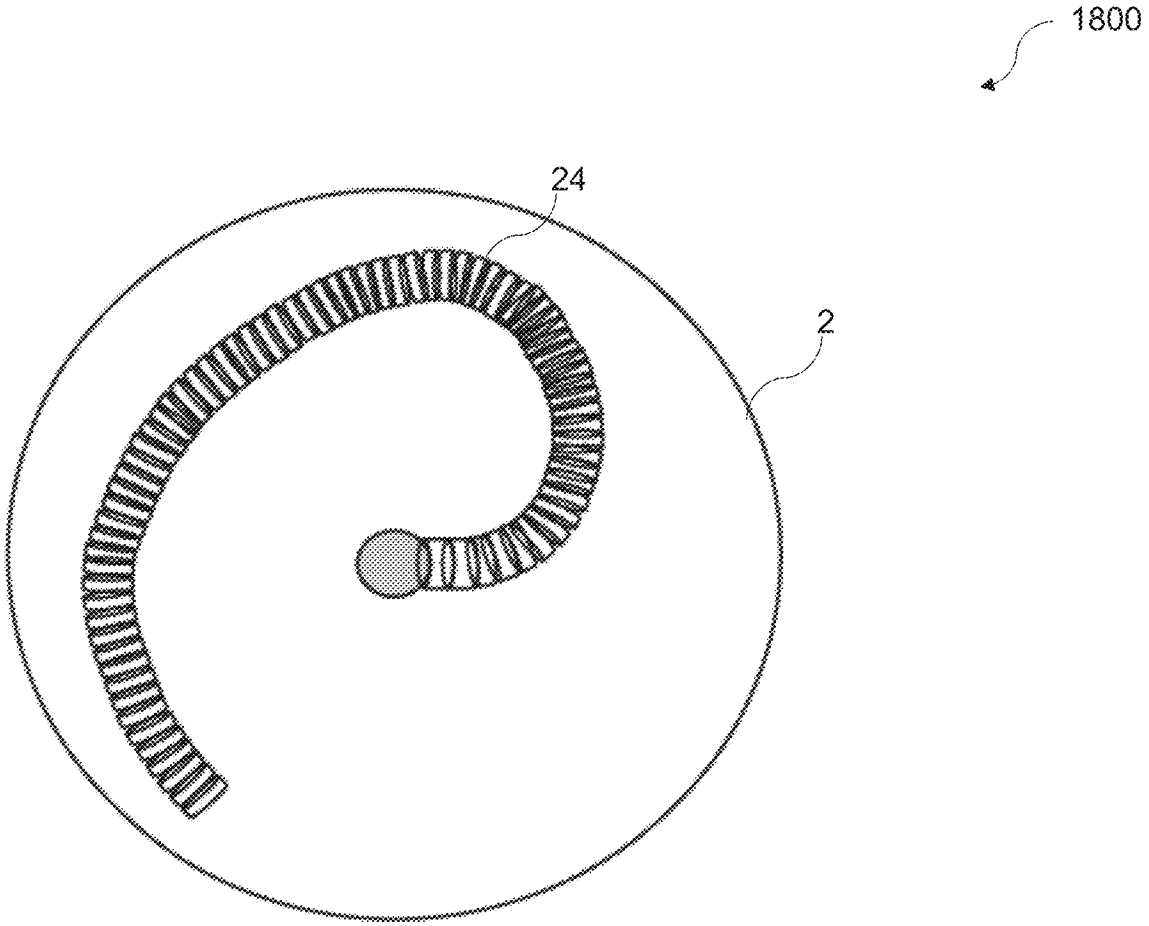
FIG. 18 depicts a bottom view of an embodiment of a coiled or corrugated configuration of a straw and a lid of a recyclable or a reusable assembly, according to at least some embodiments described herein.

Moreover, though specific shapes and configurations of the collapsible straw have been depicted herein, other shapes and configurations are contemplated by Applicant. For example, FIG. 17 and FIG. 18 depict embodiments 1700, 1800, respectively, of the collapsible straw comprising a coiled or corrugated configuration 24. As shown in FIG. 17, a first portion of the collapsible straw comprising the coiled or corrugated configuration 24 is disposed on top or bent over the lid 2 and a second portion of the collapsible straw comprising the coiled or corrugated configuration 24 is located/housed within the lid 2.

Figure 19:
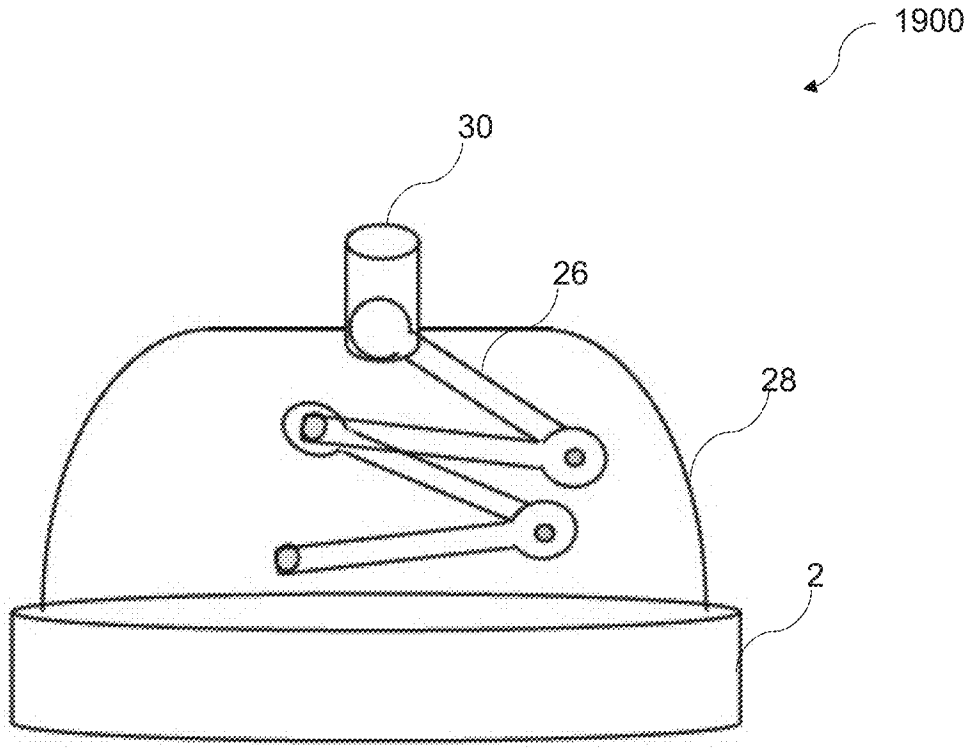
FIG. 19 depicts a perspective view of an embodiment of a ball and socket configuration of a straw in a stored or collapsed position, according to at least some embodiments described herein.
Figure 20:
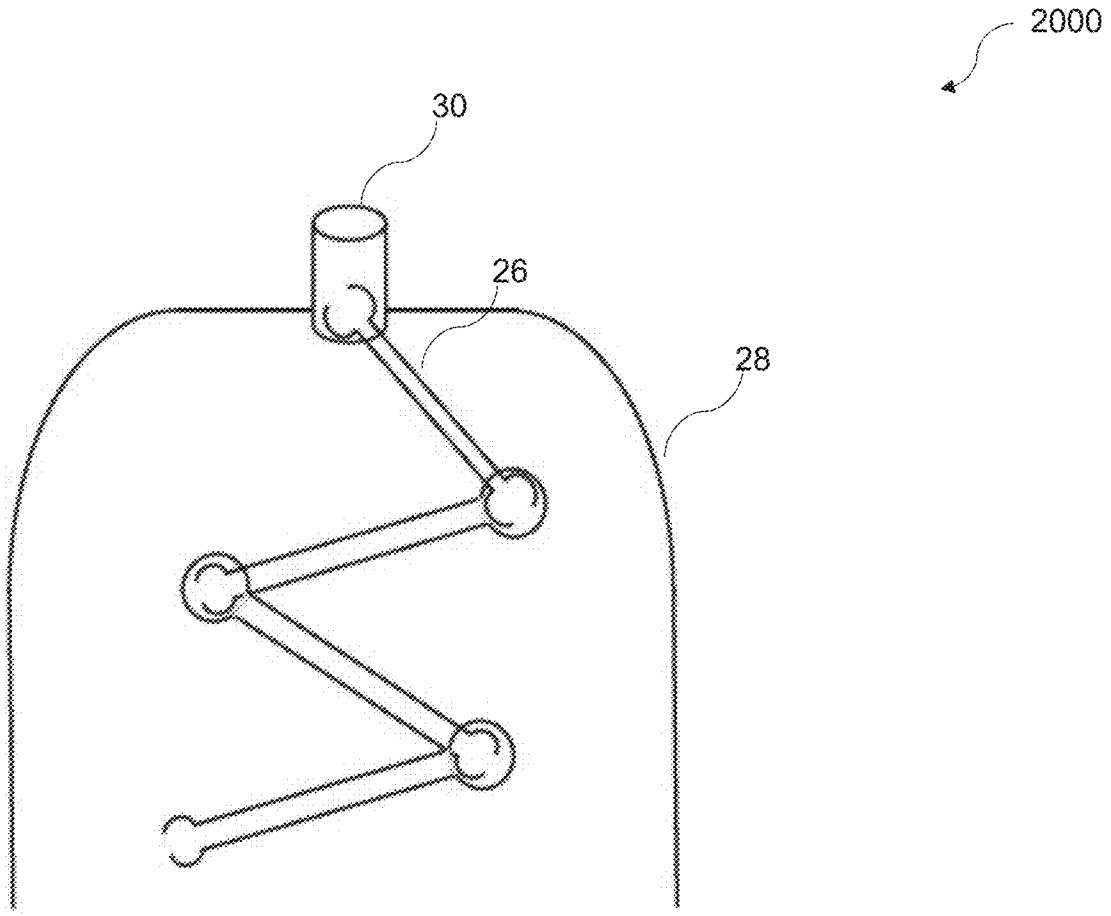
FIG. 20 depicts a perspective view of an embodiment of a ball and socket configuration of a straw in a partially extended position, according to at least some embodiments described herein.
Figure 21:
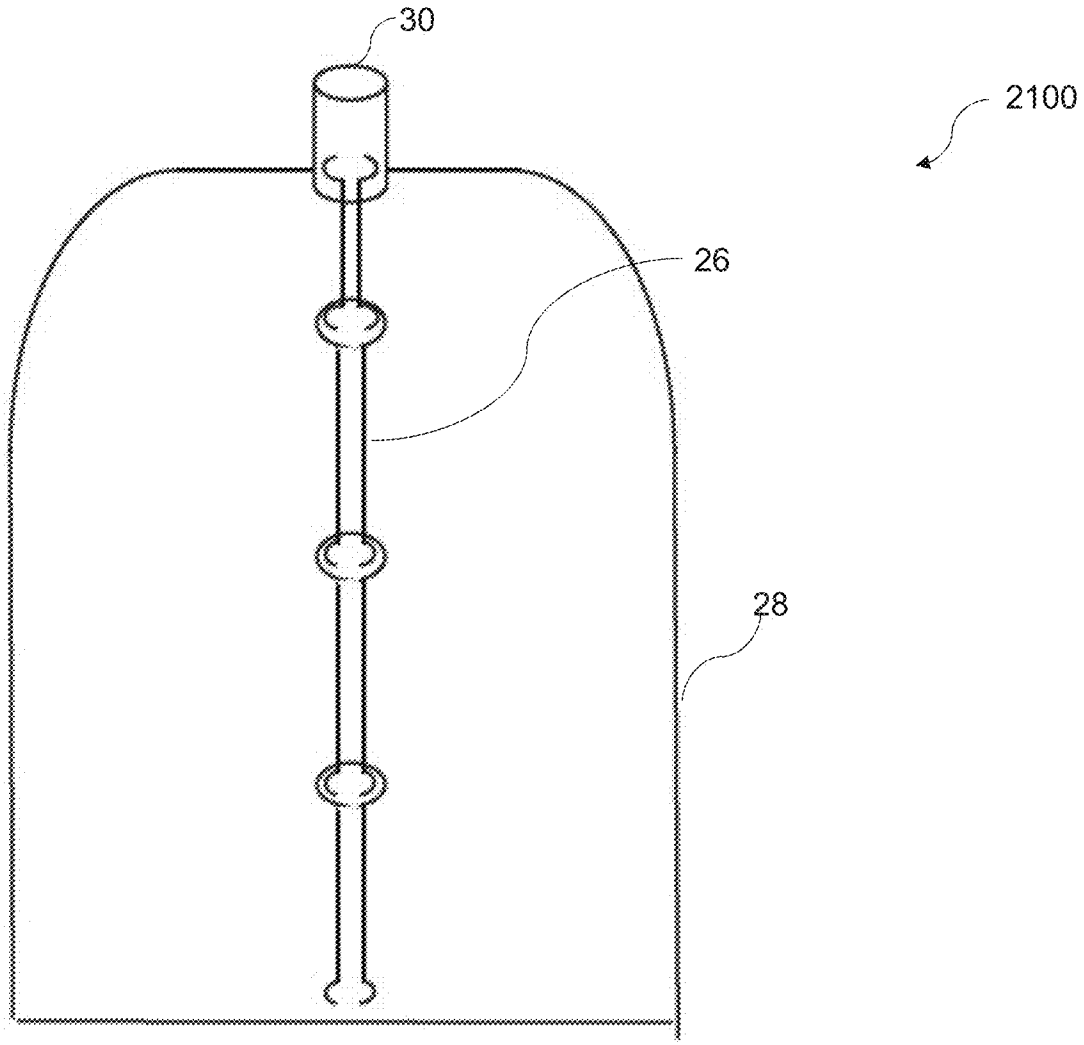
FIG. 21 depicts a perspective view of an embodiment of a ball and socket configuration of a straw in a fully extended and in-use position, according to at least some embodiments described herein.

FIG. 19, FIG. 20, and FIG. 21 depict embodiments 1900, 2000, 2100, respectively, of a ball and socket configuration of a straw 26 collapsible into the lid 2 having a dome-shape 28 and an opening 30 therewith to receive the collapsible straw. Specifically, FIG. 19 depicts the embodiment 1900 of the ball and socket configuration of the straw 26 in a collapsed position stored within the dome-shape 28 of the lid 2. Additionally, FIG. 20 depicts the embodiment 2000 of the ball and socket configuration of the straw 26 in a partially extended position and stored within the dome-shape 28 of the lid 2. Further, FIG. 21 depicts the embodiment 2100 of the ball and socket configuration of the straw 26 in a fully extended position within the dome-shape 28 of the lid 2.

Figure 25:
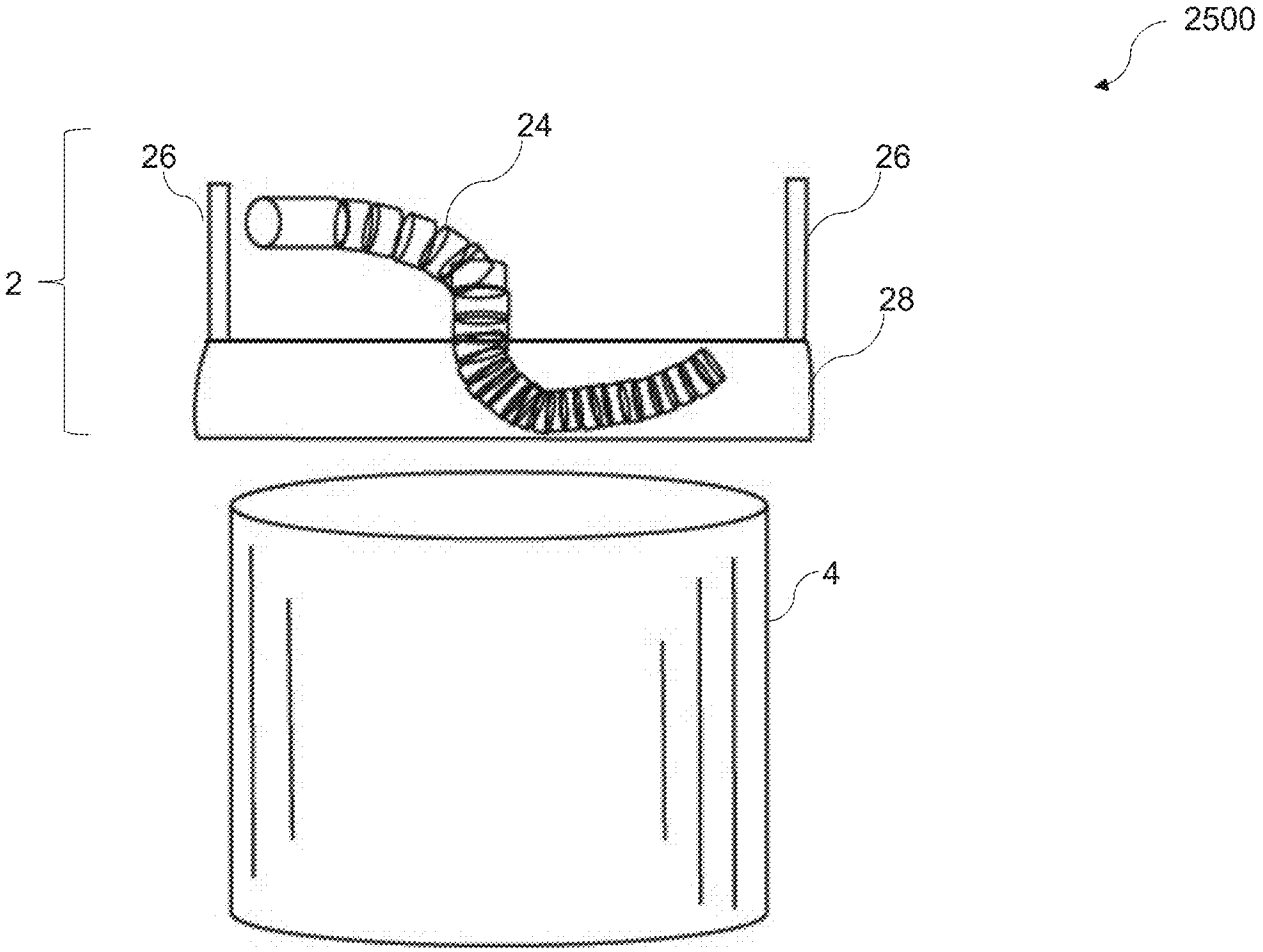
FIG. 25 depicts a perspective view of an embodiment of an extended lid of a recyclable or a reusable assembly, according to at least some embodiments described herein.
Figure 26:
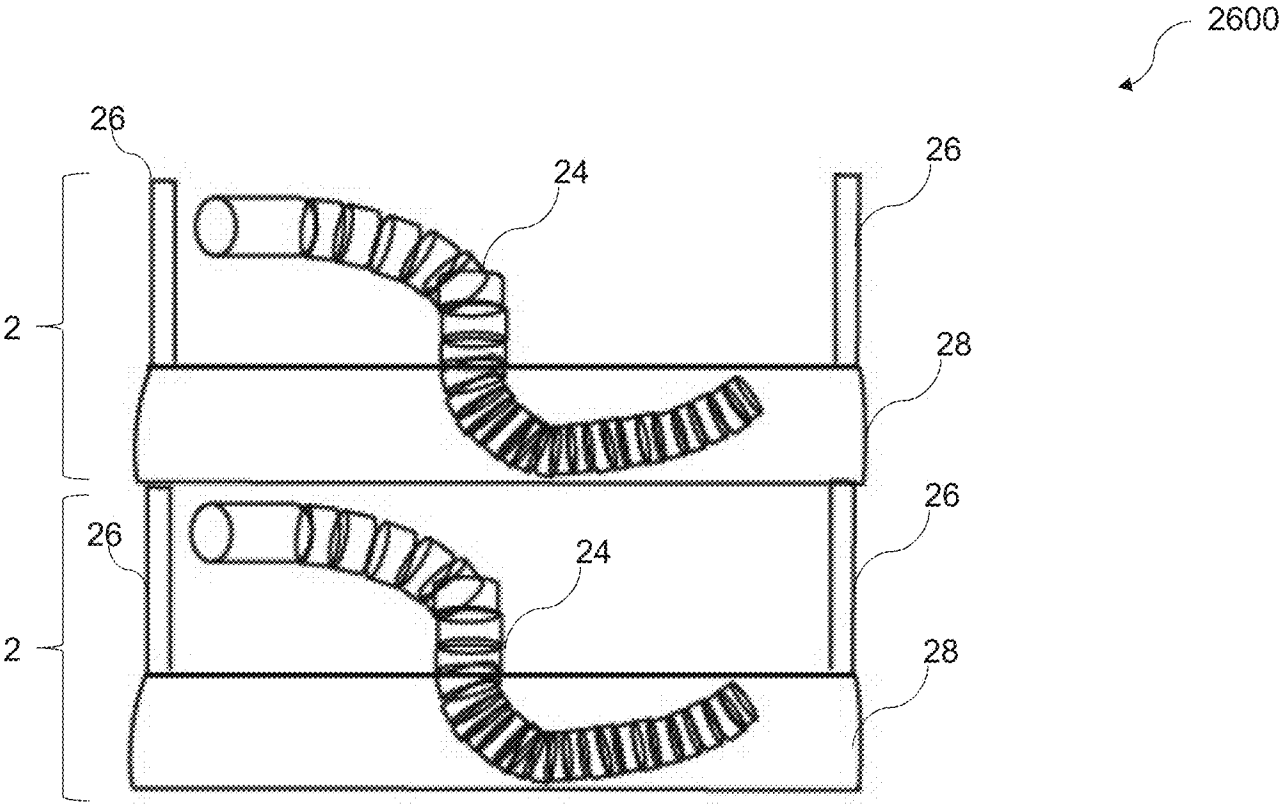
FIG. 26 depicts a perspective view of an embodiment of two stacked extended lids of a recyclable or a reusable assembly, according to at least some embodiments described herein.

Furthermore, in some examples, the lid 2 may comprise an extended configuration, as shown in embodiments 2500, 2600 of FIG. 25 and FIG. 26. The extended configuration of the lid 2 includes a planar base component 28 comprising at least two pillar components 26 extending away from the planar base component 28. In a non-use position, the coiled or corrugated configuration 24 of the collapsible straw is stored in the base component 28. FIG. 26 depicts stacking of two lids having the extended configuration. Though FIG. 26 depicts both straws having the coiled or corrugated configuration 24, in some examples, one of the straws comprises the coiled or corrugated configuration 24 and the other straw comprises another configuration, such as the ball and socket configuration, or another configuration.

Figure 27:
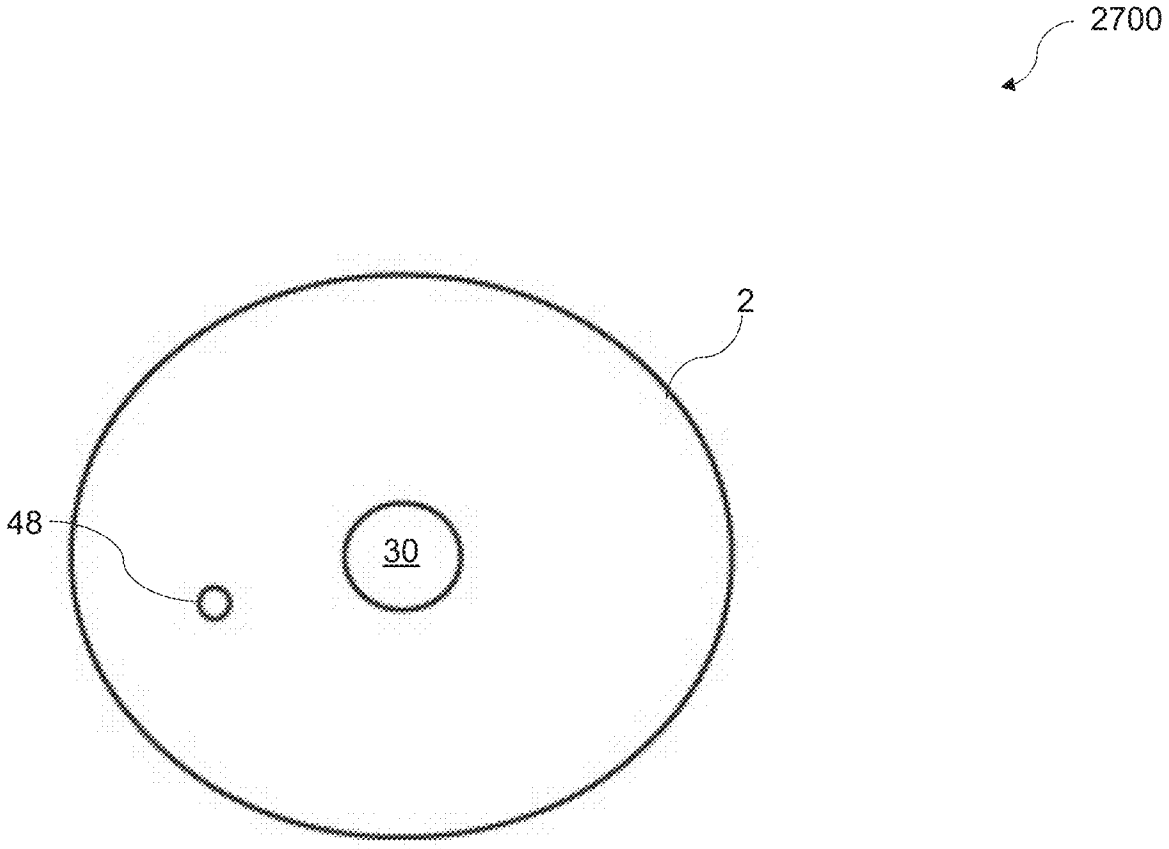
FIG. 27 depicts a perspective view of an embodiment of a lid of a recyclable or a reusable assembly having a vent hole disposed therewith, according to at least some embodiments described herein.

In some embodiments, the lid 2 may also comprise a vent hole 48 to allow for the venting of steam from a hot beverage housed within the container 4, as shown in FIG. 27. The vent hole 48 may also be used to allow air to replace the displaced liquid in the sealed container 4. Without the sealed container 4 being vented, when a user sucks the liquid out of the container 4, air may not be allowed to fill the container 4 and the container may collapse. In some examples, the lid 2 may also comprise a flap component disposed proximate the vent hole 48. The flap component may be configured to, in a closed position, seal the vent hole 48 to prevent the non-ingestible items from entering the closed container 4 and, in an open position, allow contents of the closed container 4 to be vented.

Figure 28:
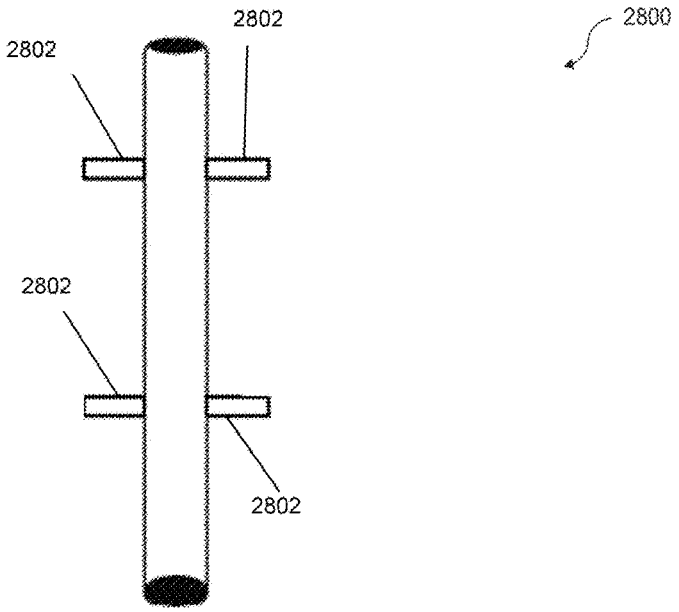
FIG. 28 depicts a perspective view of a first embodiment of a straw stabilizer system of a recyclable or a reusable assembly in an in-use position, according to at least some embodiments described herein.
Figure 29:
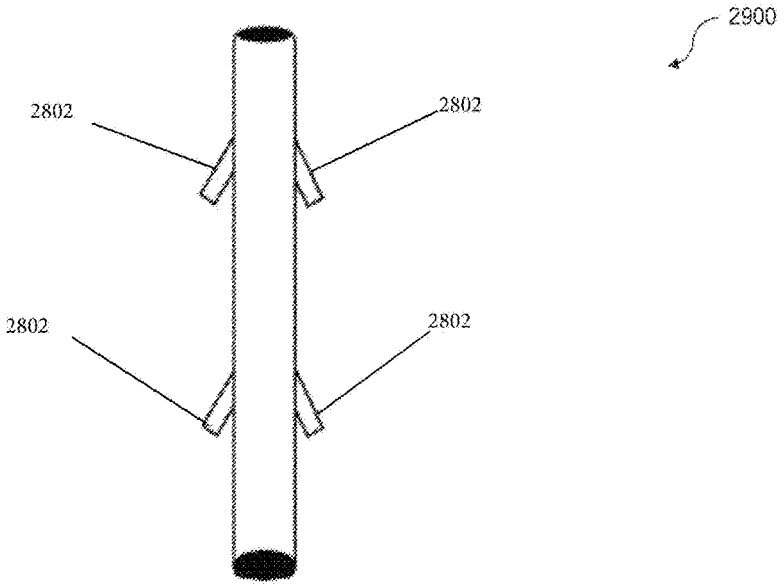
FIG. 29 depicts a perspective view of a first embodiment of a straw stabilizer system of a recyclable or a reusable assembly in a non-use position, according to at least some embodiments described herein.
Figure 30:
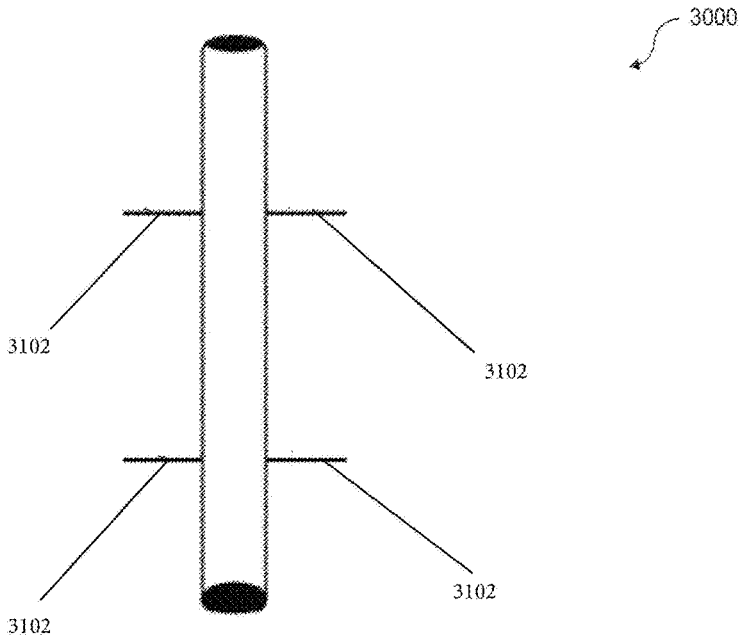
FIG. 30 depicts a perspective view of a second embodiment of a straw stabilizer system of a recyclable or a reusable assembly in an in-use position, according to at least some embodiments described herein.
Figure 31:
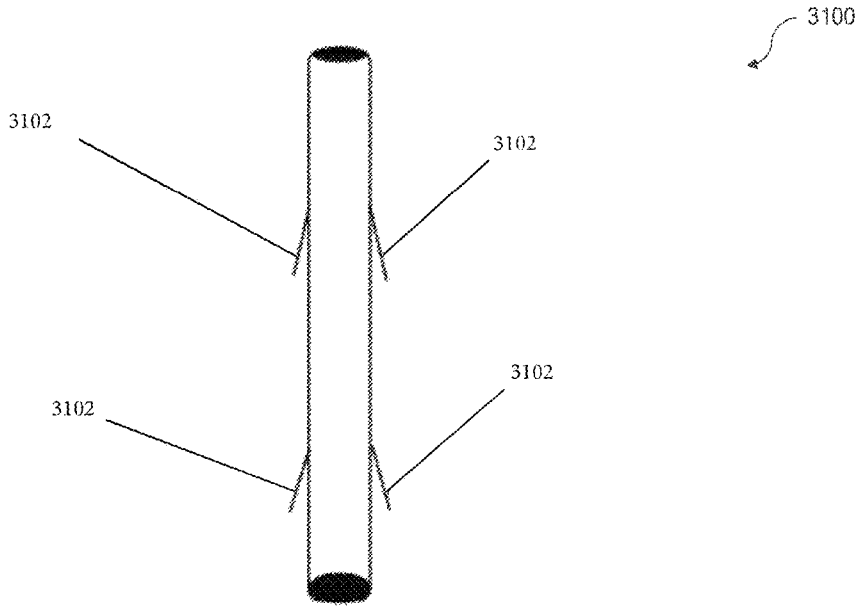
FIG. 31 depicts a perspective view of a second embodiment of a straw stabilizer system of a recyclable or a reusable assembly in a non-use position, according to at least some embodiments described herein.
Figure 32:
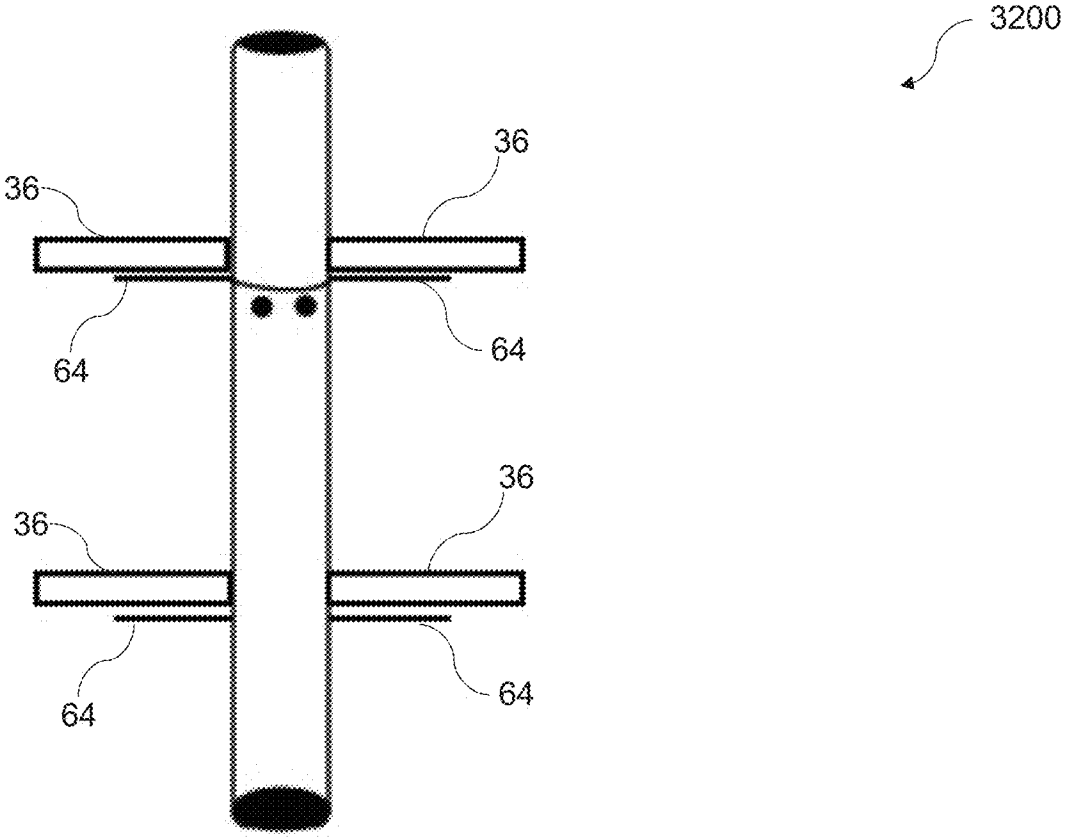
FIG. 32 depicts a perspective view of a third embodiment of a straw stabilizer system of a recyclable or a reusable assembly in an in-use position, according to at least some embodiments described herein.
Figure 33:
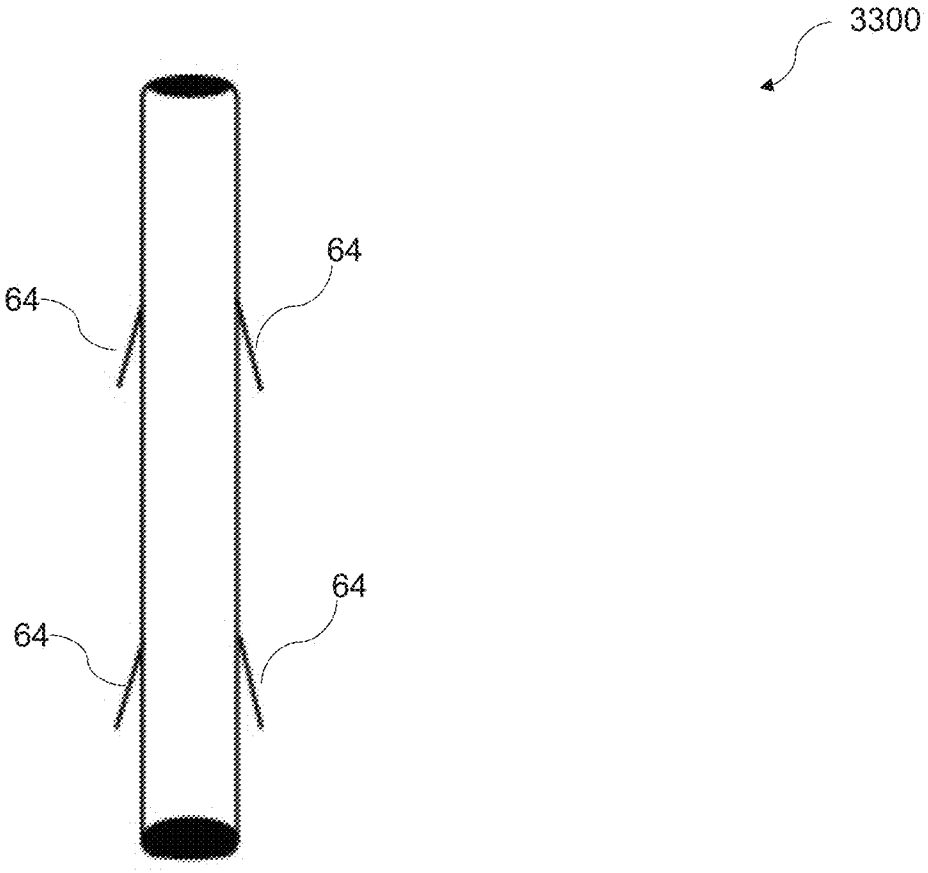
FIG. 33 depicts a perspective view of a fourth embodiment of a straw stabilizer system of a recyclable or a reusable assembly in a non-use position, according to at least some embodiments described herein.

Moreover, in some embodiments, an optional straw stabilizer system may accompany the system described herein. The straw stabilizer system increases the width/volume/size of the straw to allow for recyclability. The optional straw stabilizer system is depicted in FIG. 28-FIG. 39. Specifically, FIG. 28 and FIG. 29 depict a first embodiment 2800, 2900, respectively, of the straw stabilizer system that includes horizontal protrusions 2802 in an open position (FIG. 28) and in a closed and non-use position (FIG. 29). Moreover, FIG. 30 and FIG. 31 depict a second embodiment 3000, 3100, respectively, of the straw stabilizer system that includes planar protrusions 3102 in an open position (FIG. 30) and in a closed and non-use position (FIG. 31). Additionally, FIG. 32 depicts a third embodiment 3200 of the straw stabilizer system that includes support components 64 and column protrusions/stabilizers 36 in an open position. FIG. 33 depicts a fourth embodiment 3300 of the straw stabilizer system that includes the support components 64 in a closed position.

Figure 38:
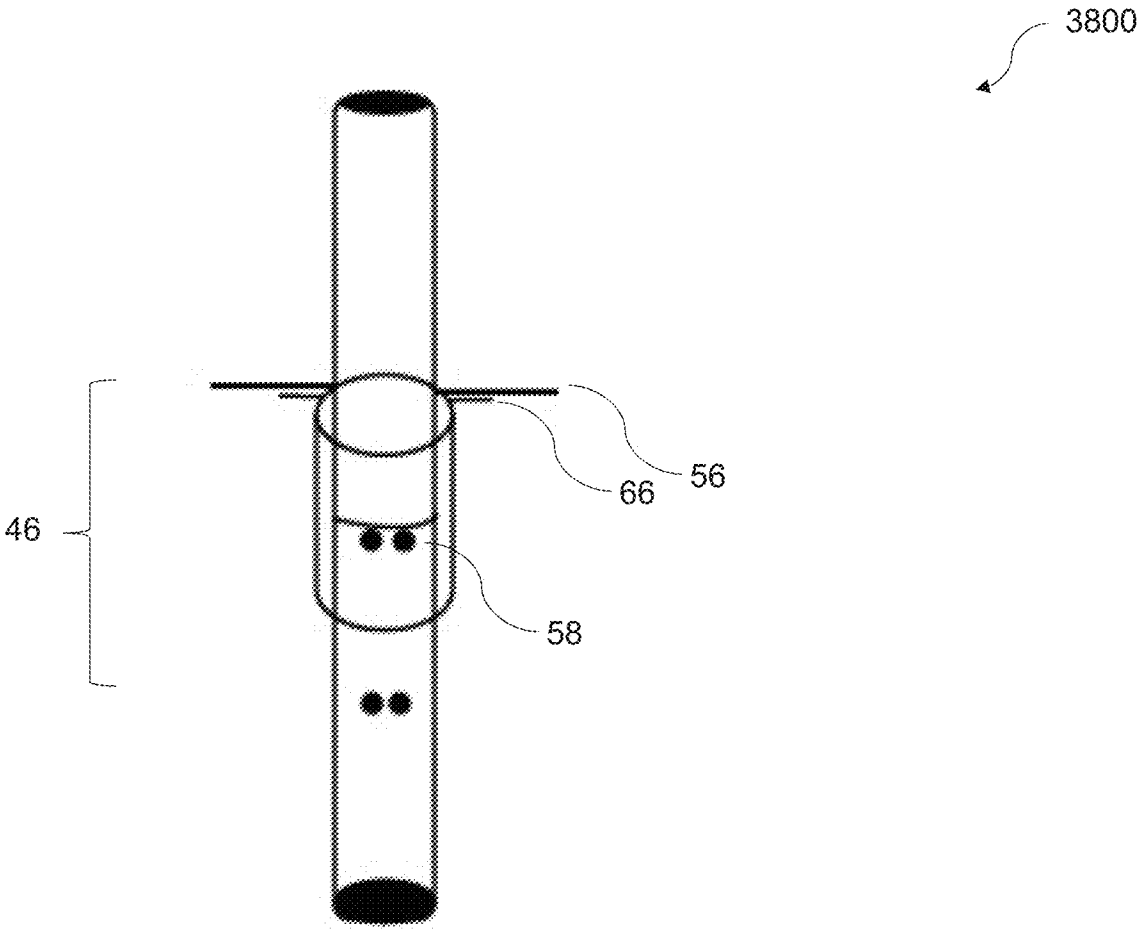
FIG. 38 depicts a perspective view of a fifth embodiment of a straw stabilizer system of a recyclable or a reusable assembly in an in-use position, according to at least some embodiments described herein.
Figure 39:
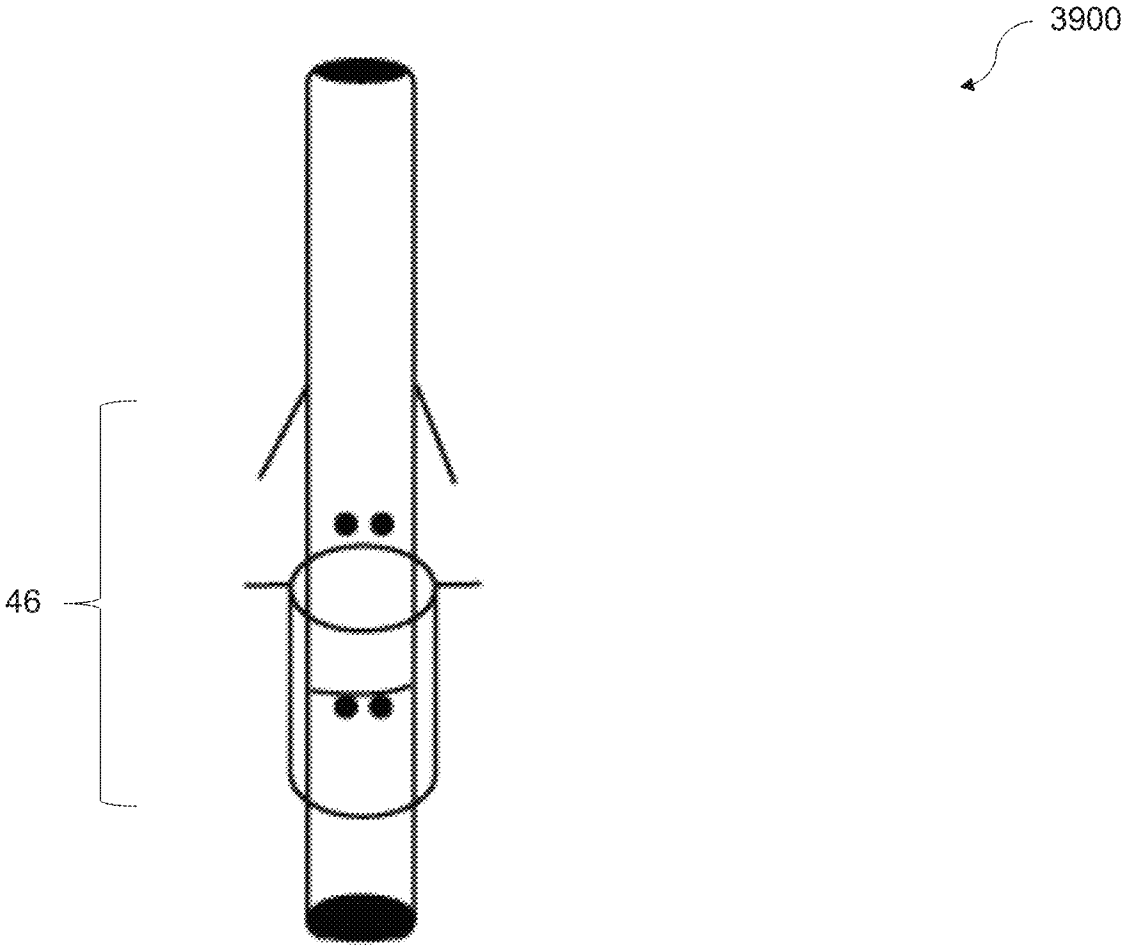
FIG. 39 depicts a perspective view of a fifth embodiment of a straw stabilizer system of a recyclable or a reusable assembly in a non-use position, according to at least some embodiments described herein.

Moreover, FIG. 38 and FIG. 39 depict a fifth embodiment 3800, 3900, respectively, of the straw stabilizer system that includes a movable sleeve 46 in an open position (FIG. 38) and in a closed and non-use position (FIG. 39). Further, FIG. 38 depicts a flange 66 referenced previously, which is affixed to the movable sleeve 46, as well as the stabilizer component 56. Moreover, it should be appreciated that the horizontal protrusions 2802, the planar protrusions 3102, and/or the column protrusions 36 comprise a range of motion relative to the straw.

Figure 34:
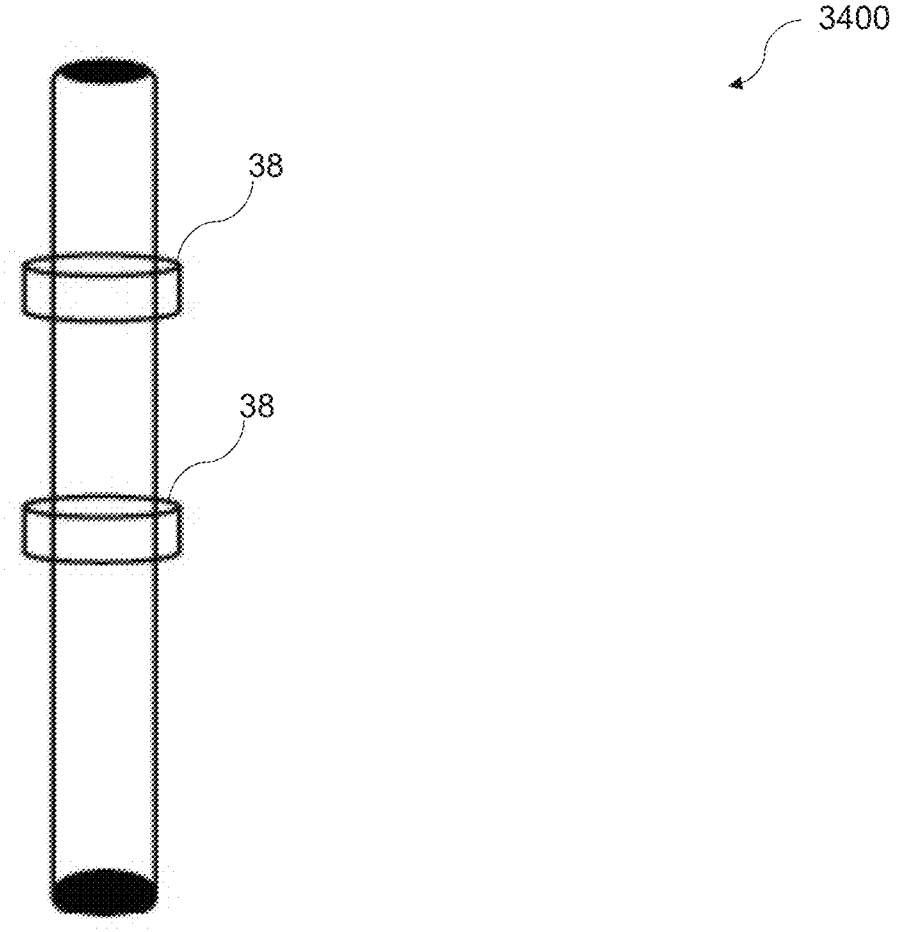
FIG. 34 depicts a perspective view of a circular straw stabilizer system of a recyclable or a reusable assembly, according to at least some embodiments described herein.
Figure 35:
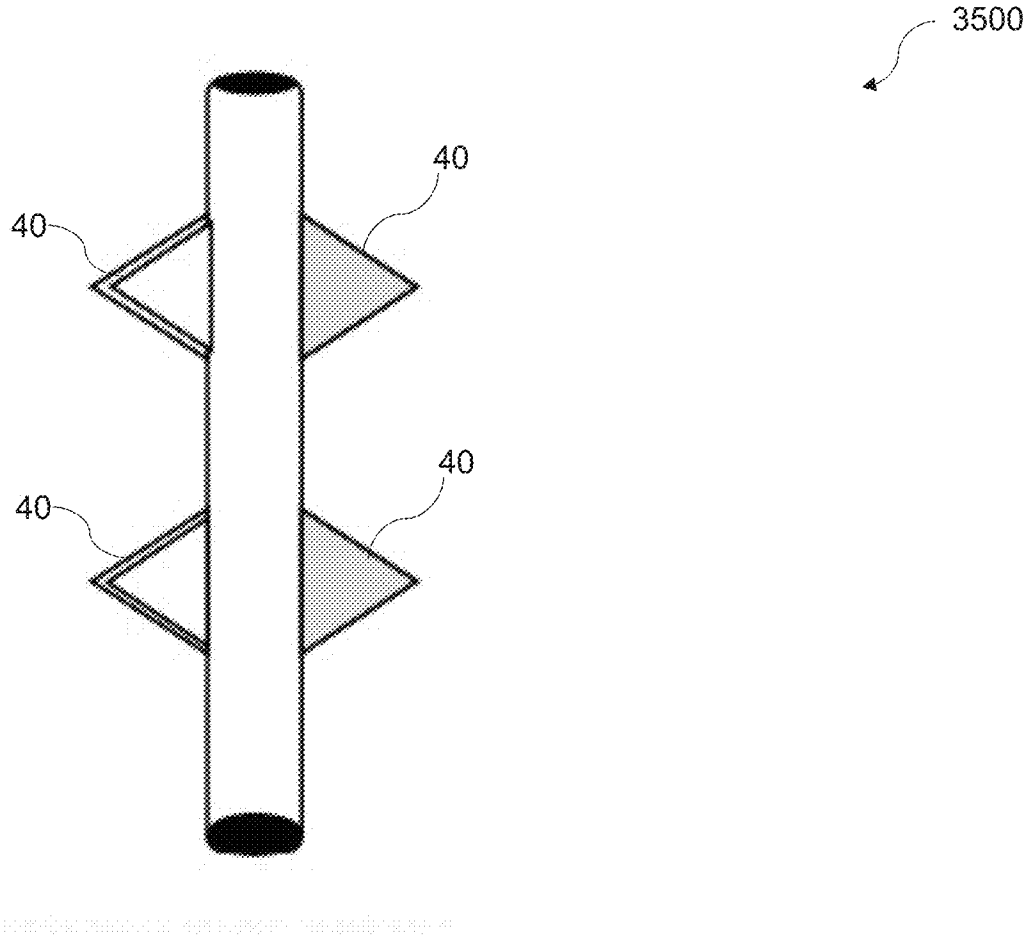
FIG. 35 depicts a perspective view of a open and solid wing stabilizer system of a recyclable or a reusable assembly, according to at least some embodiments described herein.
Figure 36:
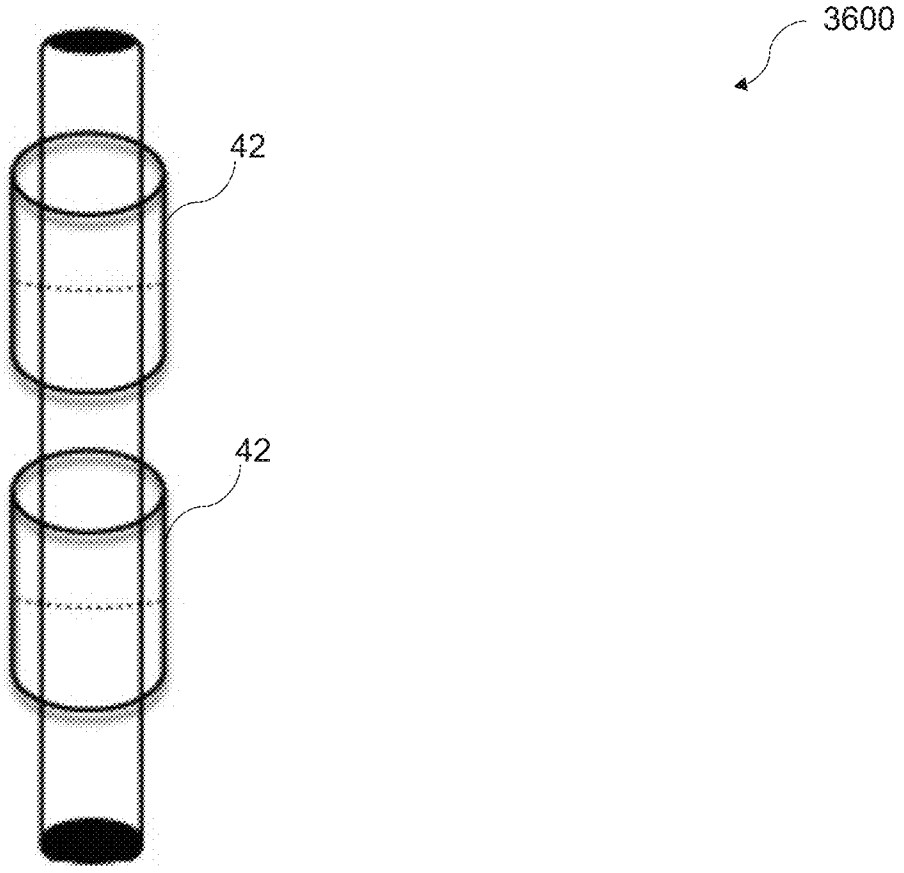
FIG. 36 depicts a perspective view of a sleeve straw stabilizer system of a recyclable or a reusable assembly, according to at least some embodiments described herein.
Figure 37:
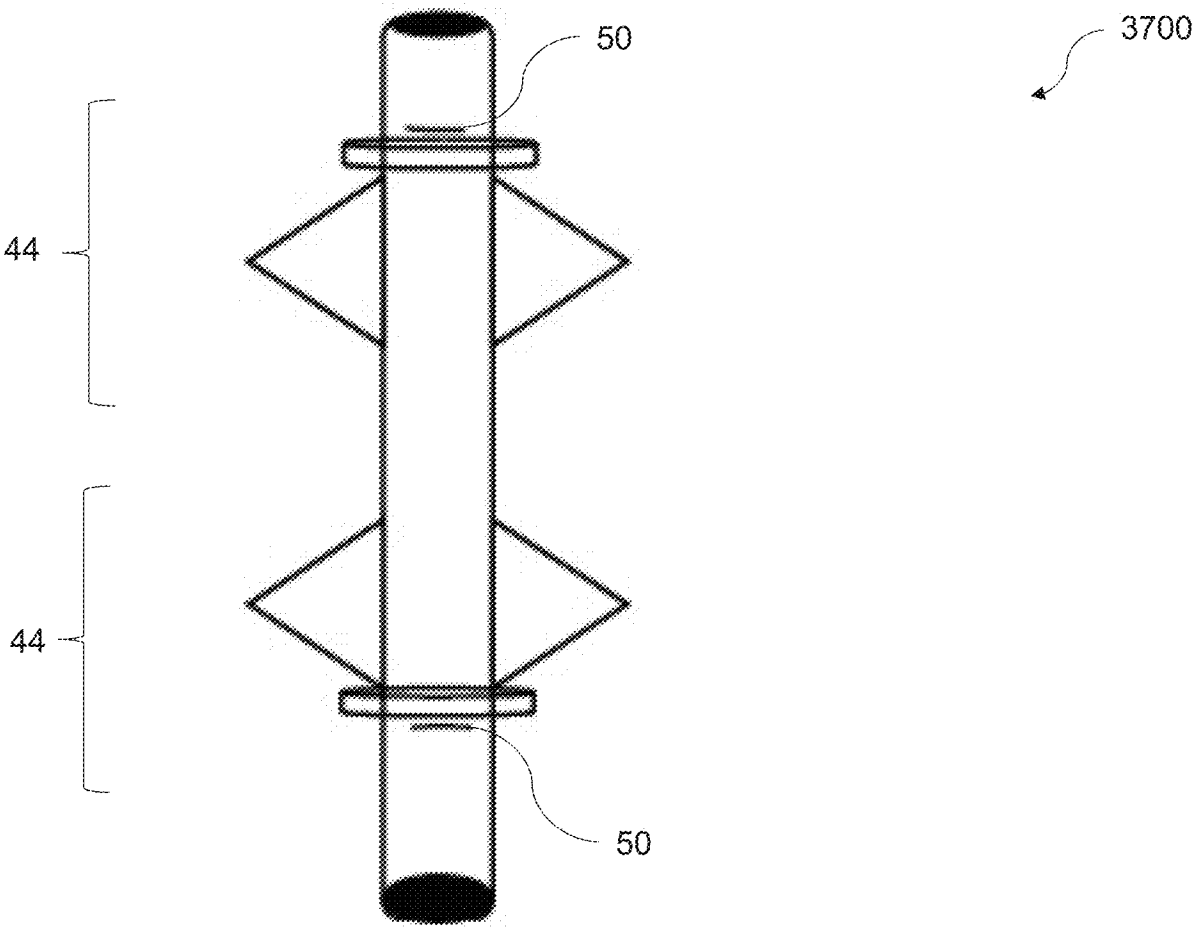
FIG. 37 depicts a perspective view of a locking ridge straw stabilizer system of a recyclable or a reusable assembly, according to at least some embodiments described herein.

Additional straw stabilizer systems are also contemplated by Applicant, such as a circular straw stabilizer system of FIG. 34 comprising cylindrical protrusions 38, a solid wing stabilizer system of FIG. 35 comprising wings 40, a sleeve stabilizer system of FIG. 36 comprising sleeves 42, and a locking ridge stabilizer system of FIG. 37 comprising locking ridges 44, among others not explicitly described or depicted herein. It should be appreciated that the quantities of the cylindrical protrusions 38, the wings 40, the sleeves 42, and/or the locking ridges 44 are not limited to any particular quantity. However, in preferred example, at least one of the cylindrical protrusions 38, at least one of the wings 40, at least one of the sleeves 42, and/or at least one of the locking ridges 44 are contemplated herein. Further, it should be appreciated that, in some examples, the horizontal protrusions 2802, the planar protrusions 3102, the column protrusions 36, the cylindrical protrusions 38, the wings 40, the sleeves 42, and/or the locking ridges 44 comprise text/or and visual graphics.

It should be appreciated that, in some examples, the optional straw stabilizer system may be removable and replaceable with another straw stabilizer system. In other examples, the straw stabilizer system may comprise one or more securing components (e.g., a flange 56 of FIG. 38 and/or securing knobs 58 of FIG. 38) to support the extended/expanded position and to secure the straw stabilizer system components. These securing components can be any shape, size, configuration, length, and/or diameter. In some examples, the range of motion is supported by a manual mechanism or an automatic mechanism. Further, in some examples, the straw and the optional straw stabilizer system are storable in a non-use position or an in-use position in the closed container 4 or in a recyclable wrapper.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A recyclable or reusable assembly comprising:

a lid comprising:

a first side disposed opposite a second side; and a hole located in a middle of the lid such that the hole extends through a width of the lid, wherein the second side of the lid engages an opening of a container to form a closed container;

a straw fully extendable for use and configured to collapse on itself in a movement, the straw having a first portion disposed opposite a second portion, wherein the first portion of the straw has a first side disposed opposite a second side, wherein the second portion of the straw has a first side disposed opposite a second side, wherein the second side of the first portion of the straw is configured to engage the hole on the first side of the lid, wherein the second side of the second portion of the straw is configured to engage the hole on the second side of the lid, and wherein the second portion of the straw resides inside of the closed container;

a first sealing plug affixed to the first side of the first portion of the straw;

a second sealing plug affixed to the first side of the second portion of the straw, such that the first sealing plug seals an inside of the first portion of the straw and the second sealing plug seals an inside of the second portion of the straw when the first sealing plug and the second sealing plug are oriented in a retracted position, the first sealing plug unseals the inside of the first portion of the straw and the second sealing plug unseals the inside of the second portion of the straw when the first sealing plug and the second sealing plug are oriented in an extended position;

a straw stabilizer system comprising:

one or more first horizontal protrusions with a first end located opposite a second end, the first end of the one or more first horizontal protrusions is connected to the straw, the one or more first horizontal protrusions is configured to be oriented in a substantially perpendicular orientation in relation to the straw during use and in a substantially parallel orientation in relation to the straw during non-use; and one or more second horizontal protrusions with a first end located opposite a second end, the first end of the one or more second horizontal protrusions is connected to the straw, the one or more second horizontal protrusions is parallel to the one or more first horizontal protrusions, the one or more first horizontal protrusions is disposed above the one or more second horizontal protrusions, the second end of the one or more first horizontal protrusions extends beyond the second end of the one or more second horizontal protrusions; and at least one fastener, the first sealing plug and the second sealing plug are connected via the at least one fastener to the lid or the straw.

2. The recyclable or reusable assembly of claim 1, wherein each fastener of the at least one fastener is selected from the group consisting of: latches, hooks, ridges, tabs, slots, threads, and adhesives.

3. The recyclable or reusable assembly of claim 1, wherein the first sealing plug is screwed or secured onto the first side of the first portion of the straw, and wherein the second sealing plug is screwed or secured onto the first side of the second portion of the straw.

4. The recyclable or reusable assembly of claim 1, wherein the straw comprises a configuration selected from the group consisting of: a collapsible configuration, a telescoping configuration, a coiled configuration, a corrugated configuration, a ball and socket configuration, a full-length configuration, and a combined telescoping and collapsible configuration.

5. The recyclable or reusable assembly of claim 1, wherein the lid comprises a configuration selected from the group consisting of: a dome configuration, a flat configuration, a substantially flat configuration, a squircle configuration, a concave configuration, a concave dome configuration, a non-flat configuration, and a bubble configuration.

6. The recyclable or reusable assembly of claim 1, wherein the lid further comprises a vent hole disposed therethrough.

7. The recyclable or reusable assembly of claim 6, wherein the lid further comprises a flap component configured to, in a closed position, seal the vent hole to prevent the non-ingestible items from entering the closed container and, in an open position, allow contents of the closed container to be vented.

8. A recyclable assembly comprising:

a lid comprising:

a first side disposed opposite a second side; and a hole located in a middle of the lid such that the hole extends through a width of the lid, wherein the second side of the lid engages an opening of a container to form a closed container;

a straw fully extendable for use and configured to collapse on itself in a movement;

a first sealing plug affixed to a first side of a first portion of the straw;

a second sealing plug affixed to a first side of a second portion of the straw, such that the first sealing plug seals an inside of the first portion of the straw and the second sealing plug seals an inside of the second portion of the straw when the first sealing plug and the second sealing plug are oriented in a retracted position, the first sealing plug unseals the inside of the first portion of the straw and the second sealing plug unseals the inside of the second portion of the straw when the first sealing plug and the second sealing plug are oriented in an extended position;

a straw stabilizer system comprising:

one or more first horizontal protrusions with a first end located opposite a second end, the first end of the one or more first horizontal protrusions is connected to the straw, the one or more first horizontal protrusions is configured to be oriented in a substantially perpendicular orientation in relation to the straw during use and in a substantially parallel orientation in relation to the straw during non-use; and one or more second horizontal protrusions with a first end located opposite a second end, the first end of the one or more second horizontal protrusions is connected to the straw, the one or more second horizontal protrusions is parallel to the one or more first horizontal protrusions, the one or more first horizontal protrusions is disposed above the one or more second horizontal protrusions, the second end of the one or more first horizontal protrusions extends beyond the second end of the one or more second horizontal protrusions; and at least one fastener, the first sealing plug and the second sealing plug are connected via the at least one fastener to the lid or the straw.

9. The recyclable assembly of claim 8, wherein the straw comprises a recyclable material or a compostable material, wherein the recyclable material is selected from the group consisting of: a biodegradable plastic, a number 4 plastic, a number 6 plastic, and a paper material, wherein the compostable material comprises a plant-based fiber or another compostable material.

10. The recyclable assembly of claim 9, wherein the biodegradable plastic is a biologically synthesized plastic is selected from the group consisting of: a polyhydroxyalkanoates (PHA) plastic, a polylactic acid (PLA) plastic, a starch blend plastic, and a cellulose-based plastic, a petroleum-based plastic, and wherein the petroleum-based plastic is selected from the group consisting of: a polyglycolic acid (PGA) plastic, a polybutylene succinate (PBS) plastic, a polycaprolactone (PCL) plastic, a poly (vinyl alcohol) (PVOH/PVA) plastic, and a polybutylene adipate terephthalate (PBAT) plastic.

11. The recyclable assembly of claim 9, wherein the straw comprises a configuration selected from the group consisting of: a collapsible configuration, a telescoping configuration, a coiled configuration, a corrugated configuration, a ball and socket configuration, a full-length configuration, and a combined telescoping and collapsible configuration.

12. The recyclable assembly of claim 9, wherein the straw comprises a first portion and a second portion, wherein the first portion of the straw engages the first side of the lid, and wherein the second portion of the straw engages the second side of the lid and resides in the closed container.

13. The recyclable assembly of claim 9, wherein the straw comprises one or more stabilizer systems located at one or more locations of the straw, wherein each of the one or more stabilizer systems comprises protrusions affixed to and extending away from the straw at the one or more locations, and wherein the one or more stabilizer systems are configured to increase a width, a volume, or a size of the straw to allow for recyclability.

14. The recyclable assembly of claim 13, wherein each of the protrusions comprise a range of motion relative to the straw, and wherein the range of motion is supported by a manual mechanism or an automatic mechanism.

15. The recyclable assembly of claim 13, wherein each of the one or more stabilizer systems further comprises a securement mechanism that is configured to secure the protrusions in a position.

16. The recyclable assembly of claim 13, wherein each of the protrusions comprise at least one of text and visual graphics.

17. The recyclable assembly of claim 13, wherein the straw and the one or more stabilizer systems are storable in a non-use position or an in-use position in the closed container or in a recyclable wrapper.

18. A reusable assembly comprising:

a lid comprising:

a first side disposed opposite a second side; and a hole located in a middle of the lid such that the hole extends through a width of the lid, wherein the second side of the lid engages an opening of a container to form a closed container;

a straw fully extendable for use and configured to collapse on itself in a movement;

a first sealing plug affixed to a first side of a first portion of the straw;

a second sealing plug affixed to the first side of a second portion of the straw, such that the first sealing plug seals an inside of the first portion of the straw and the second sealing plug seals an inside of the second portion of the straw when the first sealing plug and the second sealing plug are oriented in a retracted position, the first sealing plug unseals the inside of the first portion of the straw and the second sealing plug unseals the inside of the second portion of the straw when the first sealing plug and the second sealing plug are oriented in an extended position;

a straw stabilizer system comprising:

one or more first horizontal protrusions with a first end located opposite a second end, the first end of the one or more first horizontal protrusions is connected to the straw, the one or more first horizontal protrusions is configured to be oriented in a substantially perpendicular orientation in relation to the straw during use and in a substantially parallel orientation in relation to the straw during non-use; and one or more second horizontal protrusions with a first end located opposite a second end, the first end of the one or more second horizontal protrusions is connected to the straw, the one or more second horizontal protrusions is parallel to the one or more first horizontal protrusions, the one or more first horizontal protrusions is disposed above the one or more second horizontal protrusions, the second end of the one or more first horizontal protrusions extends beyond the second end of the one or more second horizontal protrusions; and at least one fastener, the first sealing plug and the second sealing plug are connected via the at least one fastener to the lid or the straw.

* * * * *